US010639897B2

(12) United States Patent
Matsuoka et al.

(10) Patent No.: US 10,639,897 B2
(45) Date of Patent: May 5, 2020

(54) LIQUID EJECTING APPARATUS AND METHOD OF MAINTAINING THE SAME

(71) Applicant: SEIKO EPSON CORPORATION, Tokyo (JP)

(72) Inventors: Hiroki Matsuoka, Azumino (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/149,434

(22) Filed: Oct. 2, 2018

(65) Prior Publication Data

US 2019/0105905 A1 Apr. 11, 2019

(30) Foreign Application Priority Data

Oct. 5, 2017 (JP) ..... 2017-194871

(51) Int. Cl.
*B41J 2/165* (2006.01)
*B41J 2/17* (2006.01)

(52) U.S. Cl.
CPC ..... *B41J 2/16523* (2013.01); *B41J 2/16505* (2013.01); *B41J 2/16508* (2013.01); *B41J 2/16517* (2013.01); *B41J 2/16535* (2013.01); *B41J 2/1714* (2013.01)

(58) Field of Classification Search
CPC ..... B41J 2/16505; B41J 2/16508; B41J 2/16517; B41J 2/16535
See application file for complete search history.

(56) References Cited

U.S. PATENT DOCUMENTS

| | | | | |
|---|---|---|---|---|
| 6,802,256 | B1 * | 10/2004 | Koch | B41F 23/0443 101/416.1 |
| 10,265,958 | B2 * | 4/2019 | Schafer | B41J 2/155 |
| 2009/0141069 | A1 | 6/2009 | Yamamoto | |
| 2012/0075366 | A1 | 3/2012 | Kanome et al. | |
| 2012/0306971 | A1 | 12/2012 | Kobashi et al. | |

FOREIGN PATENT DOCUMENTS

| | | | |
|---|---|---|---|
| JP | 02-179761 | A | 7/1990 |
| JP | 2002-283554 | A | 10/2002 |
| JP | 2004-314361 | A | 11/2004 |
| JP | 2009-066770 | A | 4/2009 |
| JP | 2009-132026 | A | 6/2009 |
| JP | 2012-066541 | A | 4/2012 |
| JP | 2013-212679 | A | 10/2013 |
| JP | 2012-245714 | A | 12/2013 |

* cited by examiner

*Primary Examiner* — Lamson D Nguyen
(74) *Attorney, Agent, or Firm* — Workman Nydegger

(57) ABSTRACT

A liquid ejecting apparatus includes a liquid ejecting unit, a carriage, an optical machine, a liquid receiving unit, and a suction mechanism. The liquid ejecting unit is designed to form an image by ejecting a droplet from a nozzle formed in a nozzle forming surface to a medium. The carriage holds the liquid ejecting unit. The optical machine is held by the carriage. The liquid receiving unit is designed to receive a liquid discharged from the liquid ejecting unit in a discharge operation for maintenance of the liquid ejecting unit. The suction mechanism has a surface provided with a suction opening that allows ambient air on a liquid ejecting unit side to be sucked therefrom during the discharge operation.

7 Claims, 15 Drawing Sheets

Z

LIQUID EJECTING APPARATUS AND METHOD OF MAINTAINING THE SAME

BACKGROUND

1. Technical Field

The present invention relates to liquid ejecting apparatuses such as, for example, ink jet printers and a method of maintaining the liquid ejecting apparatuses.

2. Related Art

Examples of liquid ejecting apparatuses include, for example, an ink jet printer which performs recording by discharging (ejecting) ink (liquid) from a plurality of nozzle openings (nozzles) formed in a recording head (liquid ejecting unit) to recording paper (medium) (for example, JP-A-2004-314361).

The printer includes a sensor (optical machine) provided in the recording head and a cap member that closes a nozzle surface (nozzle forming surface) of the recording head. The printer performs a flushing operation by discharging ink droplets (droplets) from the recording head to the cap member.

In the flushing operation, a mist (airborne droplets) may be generated by atomization and flying of the ink due to discharge of the ink droplets. When this mist adheres to the sensor, the detection accuracy of the sensor may be reduced.

Such a problem is not limited to the printer equipped with the sensor but substantially common to the liquid ejecting apparatuses equipped with the optical machine.

SUMMARY

An advantage of some aspects of the invention is to provide a liquid ejecting apparatus in which adhering of droplets to an optical machine is reduced and a method of maintaining the liquid ejecting apparatus.

A liquid ejecting apparatus includes a liquid ejecting unit, a carriage, an optical machine, a liquid receiving unit, and a suction mechanism. The liquid ejecting unit is designed to form an image by ejecting a droplet from a nozzle formed in a nozzle forming surface to a medium. The carriage holds the liquid ejecting unit. The optical machine is held by the carriage. The liquid receiving unit is designed to receive a liquid discharged from the liquid ejecting unit in a discharge operation for maintenance of the liquid ejecting unit. The suction mechanism has a surface provided with a suction opening that allows ambient air on a liquid ejecting unit side to be sucked therefrom during the discharge operation.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of a liquid ejecting apparatus is described below with reference to the drawings.

Figure 1:
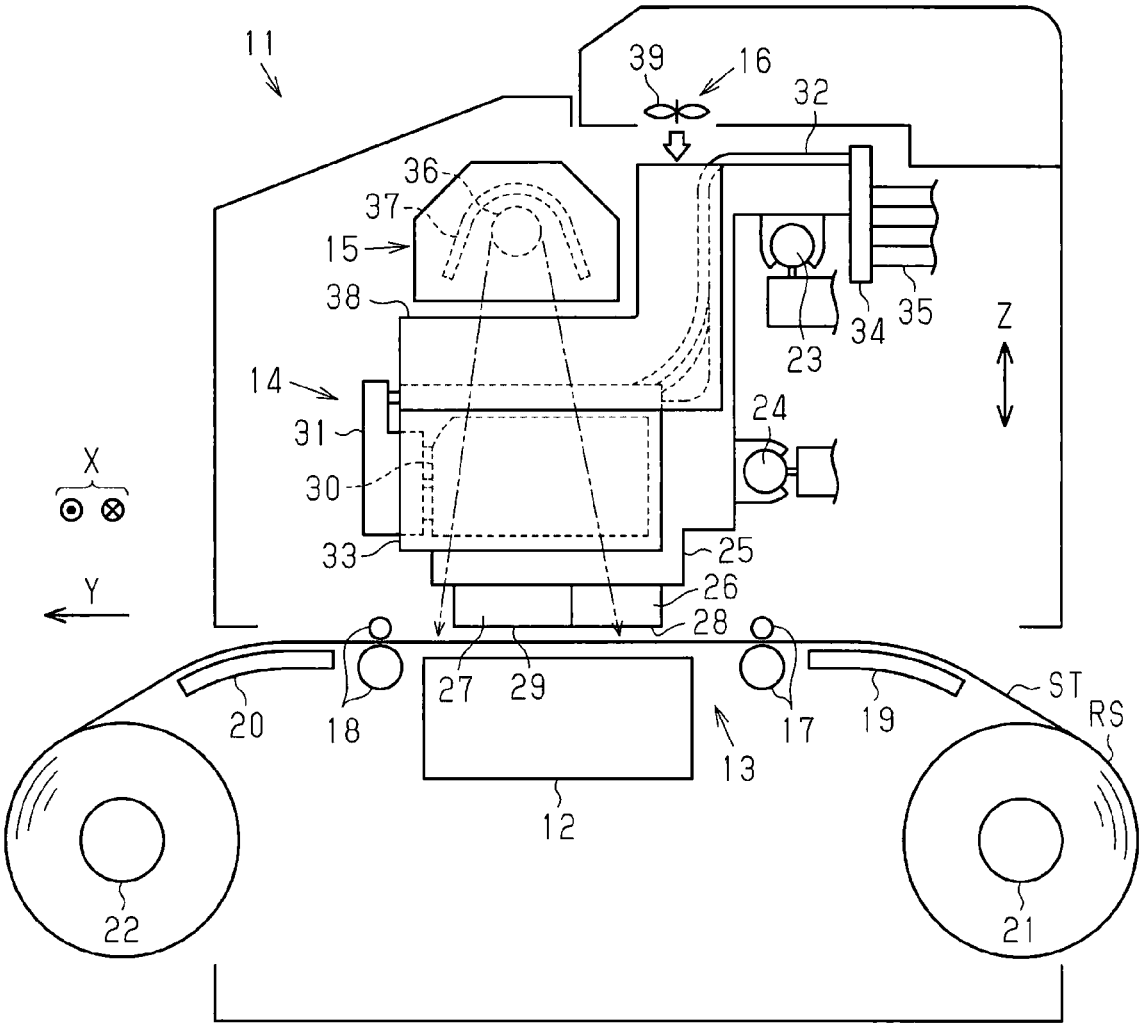
FIG. 1 is a side view schematically illustrating an embodiment of a liquid ejecting apparatus.

As illustrated in FIG. 1, a liquid ejecting apparatus 11 includes a support table 12 and a transport unit 13. The support table 12 supports a medium ST. The transport unit 13 transports the medium ST along the surface of the support table 12 in the transport direction Y. The liquid ejecting apparatus 11 also includes a liquid ejecting unit 14, a heater unit 15, and a blower 16. The liquid ejecting unit 14 ejects liquids to the medium ST transported by the transport unit 13. The heater unit 15 and the blower 16 dry the liquids adhering to the medium ST.

The support table 12 is elongated in the width direction X intersecting the transport direction Y in the horizontal plane. The support table 12 supports the medium ST from below in the vertical direction Z. The transport unit 13 includes transport roller pairs 17, 18 respectively positioned upstream and downstream of the support table 12 in the transport direction Y. A guide plate 19 is disposed upstream of the transport roller pair 17 in the transport direction Y and a guide plate 20 is disposed downstream of the transport roller pair 18 in the transport direction Y. The transport roller pairs 17, 18 are rotated while pinching the medium ST therebetween so as to transport the medium ST along the surfaces of the support table 12 and the guide plates 19, 20.

The liquid ejecting unit 14 is disposed above the support table 12 so as to face the surface of the support table 12. The liquid ejecting unit 14 ejects the liquids to the medium ST supported by the support table 12 so as to print images such as characters and photographs on the medium ST. According to the present embodiment, the medium ST includes, for example, a sheet of paper that is unwound from a roll of paper RS wound on a supply reel 21 in a roll shape, thereby being transported as a continuous paper. The medium ST on which printing has been performed by the liquid ejecting unit 14 is wound into a roll shape again by a wind-up reel 22.

The liquid ejecting apparatus 11 includes guide shafts 23, 24 and a carriage 25. The guide shafts 23, 24 extend in the width direction X of the medium ST. The carriage 25 is supported by the guide shafts 23, 24. The liquid ejecting unit 14 is held by the carriage 25. The carriage 25 can reciprocate, by using a drive source (not illustrated), in the width direction X exemplifying the scan direction. That is, when a direction in which the medium ST is transported is the transport direction Y, the carriage 25 performs scanning in the width direction X intersecting the transport direction Y.

The liquid ejecting unit 14 includes a first liquid ejecting head 26 and a second liquid ejecting head 27 that eject different liquids having different properties. The first liquid ejecting head 26 can eject a first liquid. The second liquid ejecting head 27 can eject a second liquid that is a different liquid from the first liquid. According to the present embodiment, the first liquid is a treatment liquid that enhances fixing of the second liquid to the medium ST. According to the present embodiment, the second liquid is, for example, water-based ink containing water as the solvent. That is, the first liquid adheres to the medium ST before the second liquid so as to enhance the fixing of the second liquid to the medium ST.

The first and second liquid ejecting heads 26, 27 are mounted on the carriage 25 so as to face the support table 12. The lower surfaces of the first and second liquid ejecting heads 26, 27 facing the support table 12 serve as nozzle forming surfaces 28, 29. The first and second liquid ejecting heads 26, 27 are disposed at different positions from each other in the transport direction Y. According to the present embodiment, the first liquid ejecting head 26 is disposed upstream of the second liquid ejecting head 27 in the transport direction Y. That is, the first liquid ejecting head 26 is disposed so that the first liquid ejecting head 26 can eject the liquid earlier than the second liquid ejecting head 27 to the medium ST transported from the upstream side in the transport direction Y.

The liquid ejecting unit 14 includes storage units 30 that store the first and second liquids so as to supply the first and second liquids to the first and second liquid ejecting heads 26, 27. The liquid ejecting unit 14 includes connecting tubes 32 through which the first and second liquids are supplied to the storage units 30 through channel adaptors 31. The storage units 30 are respectively provided for the individual types of the liquids to be ejected by the liquid ejecting unit 14. According to the present embodiment, two or more storage units 30 are provided so as to correspond to at least the first and second liquids. The storage units 30 are held by holders 33 attached to the carriage 25. The channel adaptors 31 are connected to downstream end portions of the connecting tubes 32. Upstream end portions of the connecting tubes 32 are connected to downstream end portions of supply tubes 35 through connecting portions 34 provided in the carriage 25. The supply tubes 35 are deformable so as to follow movements of the carriage 25. Upstream end portions of the supply tubes 35 are connected to liquid containers (not illustrated) that contain the liquids.

The heater unit 15 is disposed so as to face the support table 12 with the liquid ejecting unit 14 interposed therebetween in the vertical direction Z. The heater unit 15 is elongated in the width direction X so as to correspond to the support table 12. The heater unit 15 includes a heater element 36 and a reflector plate 37. The heater element 36 includes, for example, an infrared heater, generating heat by infrared rays. The heater unit 15 heats as indicated by one-dot chain line in FIG. 1 the medium ST, which is supported by the support table 12, by using the infrared rays radiated from the heater element 36 and radiant heat reflected by the reflector plate 37. Thus, the heater unit 15 enhances drying of the liquids adhering to the medium ST. The carriage 25 includes an insulating member 38 at the upper surface. The insulating member 38 insulates the carriage 25 from the heat from the heater unit 15. The insulating member 38 includes, for example, a metal material such as stainless steel, aluminum, or the like. The blower 16 includes a blower fan 39 that causes wind to blow to the medium ST supported by the support table 12. The blower 16 disperses the liquids having been vaporized by the heater unit 15, thereby enhancing drying of the liquids.

Figure 2:
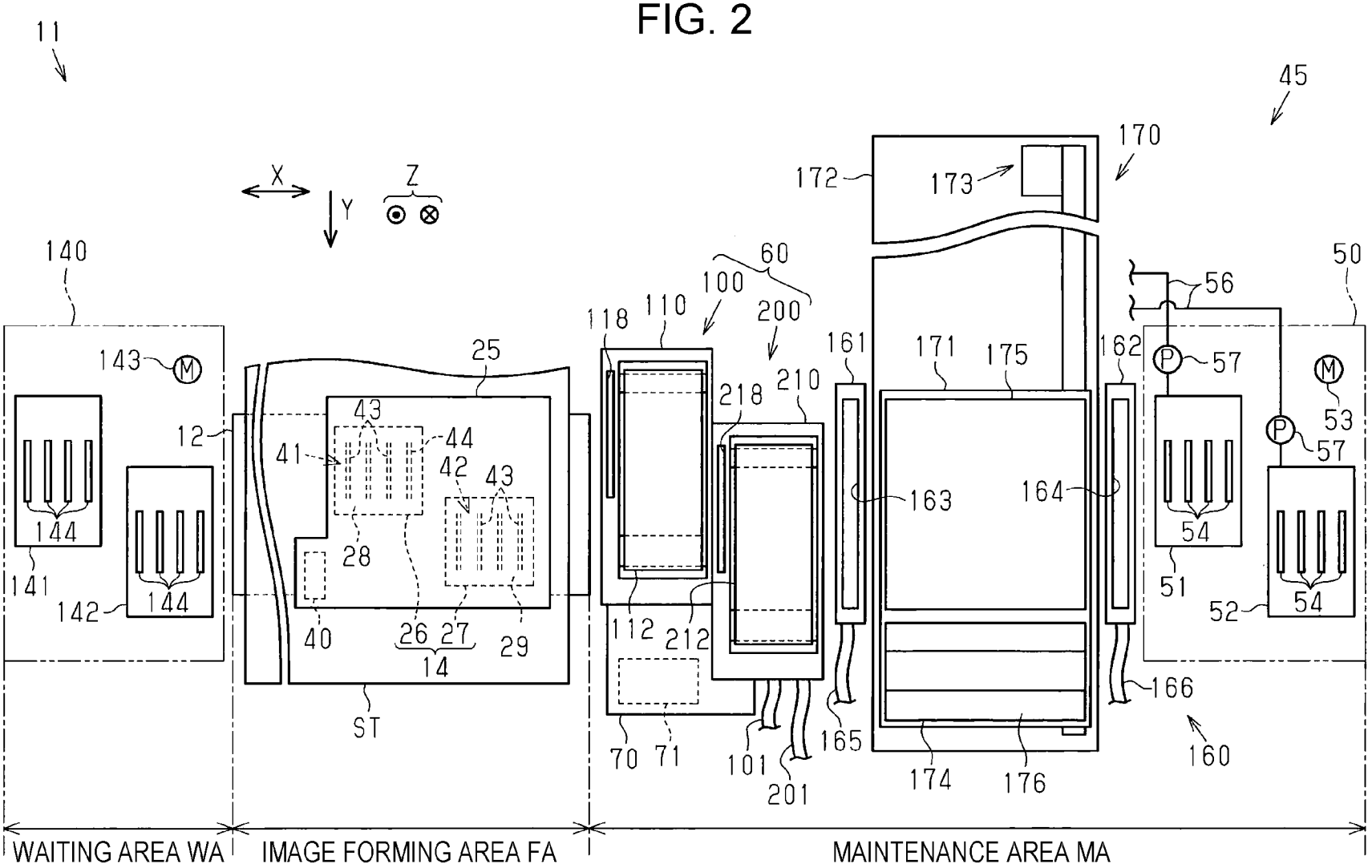
FIG. 2 is a top view schematically illustrating part of the liquid ejecting apparatus.

As illustrated in FIG. 2, the liquid ejecting apparatus 11 includes an optical machine 40 held by the carriage 25. The optical machine 40 is disposed above the support table 12 and can face the surface of the support table 12. The optical machine 40 according to the present embodiment is an image sensor that reads images printed on the medium ST. The optical machine 40 is not limited to an image sensor and may be an edge detection sensor that detects the edges of the medium ST. The optical machine 40 may be a radiating device that radiates ultraviolet rays or the like, and the liquid ejecting unit 14 may eject a liquid to be cured by ultraviolet rays.

The first and second liquid ejecting heads 26, 27 and the optical machine 40 are disposed at different positions so as to be partially superposed on one another in the transport direction Y and not to be superposed on one another in the width direction X. In other words, the first and second liquid ejecting heads 26, 27 are disposed at different positions so as to be partially superposed on each other when seen in the width direction X, and the second liquid ejecting head 27 and the optical machine 40 are disposed at different positions so as to be partially superposed on each other when seen in the width direction X. The first and second liquid ejecting heads 26, 27 and the optical machine 40 are disposed at different positions so as not to be superposed one another when seen in the transport direction Y.

A first nozzle group 41, from which the first liquid is ejected, is formed in the nozzle forming surface 28 of the first liquid ejecting head 26. A second nozzle group 42, from which the second liquid is ejected, is formed in the nozzle forming surface 29 of the second liquid ejecting head 27. Thus, the liquid ejecting unit 14 includes the first nozzle group 41 and the second nozzle group 42.

The positions of the first nozzle group 41 and the second nozzle group 42 are adjacent to each other in the width direction X and different from each other in the transport direction Y. That is, the first nozzle group 41 is disposed at a different position from that of the second nozzle group 42 when seen in the width direction X. The optical machine 40 is disposed at a position kept further separated from the second nozzle group 42 than the first nozzle group 41 in the width direction X and on the second nozzle group 42 side relative to the first nozzle group 41 in the transport direction Y.

The first and second nozzle groups 41, 42 each include a plurality of nozzle rows 43. According to the present embodiment, the first and second nozzle groups 41, 42 each include eight nozzle rows 43. The eight nozzle rows 43 each include pairs of nozzle rows 43. These pairs are equally spaced in the width direction X, and in each of the pairs, two nozzle rows 43 are closely arranged in the width direction X. The nozzle rows 43 each include many (for example, 180) nozzles 44 formed so as to be equally spaced from one another in the transport direction Y. That is, the nozzle rows 43 extend in the transport direction Y. The liquid ejecting unit 14 ejects, by driving of actuators (not illustrated), to the medium ST droplets of the first and second liquids from openings of the nozzles 44 formed in the nozzle forming surfaces 28, 29 of the first and second liquid ejecting heads 26, 27 so as to be able to form an image.

The liquid ejecting apparatus 11 has an image forming area FA extending in the width direction X. The liquid ejecting unit 14 ejects the droplets to the medium ST supported by the support table 12 so as to form images in the image forming area FA. That is, in the image forming area FA, the liquid ejecting unit 14 can eject at least one of the first and second liquids to the medium ST. According to the present embodiment, the image forming area FA corresponds to an area in which the medium ST is supported by the support table 12 in the width direction X.

The liquid ejecting apparatus 11 also has a maintenance area MA and a waiting area WA positioned adjacent to the image forming area FA in the width direction X. In the liquid ejecting apparatus 11, the maintenance area MA is provided close to one end portion (close to an end portion on the right side in FIG. 2) in the width direction X and adjacent to the image forming area FA in the width direction X. In the liquid ejecting apparatus 11, the waiting area WA is provided close to the other end portion (close to an end portion on the left side in FIG. 2) in the width direction X and adjacent to the image forming area FA on the opposite side to the maintenance area MA in the width direction X.

The maintenance area MA and the waiting area WA are provided such that the image forming area FA is interposed between the maintenance area MA and the waiting area WA in the width direction X. In other words, in the liquid ejecting apparatus 11, the image forming area FA is provided from a position adjacent to the maintenance area MA to a position adjacent to the waiting area WA in the width direction X. It can be said that, relative to the image forming area FA, the maintenance area MA and the waiting area WA are located outside the image forming area FA in the width direction X.

A maintenance unit 45 for maintenance of the liquid ejecting unit 14 is provided in the maintenance area MA. A capping mechanism 140 with which the nozzle forming surfaces 28, 29 including the nozzles 44 are capped is provided in the waiting area WA. The maintenance unit 45 and the capping mechanism 140 are disposed adjacent to the support table 12 with the support table 12 interposed therebetween in the width direction X. The maintenance unit 45 and the capping mechanism 140 can face the liquid ejecting unit 14.

The capping mechanism 140 includes a first moisture-retentive cap unit 141 and a second moisture-retentive cap unit 142 that can be respectively brought into contact with the first liquid ejecting head 26 and the second liquid ejecting head 27. The first and second moisture-retentive cap units 141, 142 are disposed at different positions in the transport direction Y so as to correspond to the disposition of the first and second liquid ejecting heads 26, 27. In more detail, according to the present embodiment, the first moisture-retentive cap unit 141 is kept further separated from the image forming area FA than the second moisture-retentive cap unit 142 in the width direction X and upstream of the second moisture-retentive cap unit 142 in the transport direction Y. The capping mechanism 140 includes a moisture retaining motor 143 that operates the first and second moisture-retentive cap units 141, 142. The first and second moisture-retentive cap units 141, 142 are, by motive power of the moisture retaining motor 143, movable between contact positions where the first and second moisture-retentive cap units 141, 142 are in contact with the first and second liquid ejecting heads 26, 27, respectively, and retracted positions where the first and second moisture-retentive cap units 141, 142 are kept separated from the first and second liquid ejecting heads 26, 27, respectively.

The first and second moisture-retentive cap units 141, 142 each include four moisture-retentive caps 144. The nozzles 44 can be capped with the moisture-retentive caps 144. The term to "cap" refers to formation of a closed space that surrounds the nozzles 44. Each pair of the nozzle rows 43 in which two nozzle rows 43 are closely arranged in the width direction X can be capped with a corresponding one of the moisture-retentive caps 144. That is, eight nozzle rows 43 can be simultaneously capped with four moisture-retentive caps 144 of a corresponding one of the first and second moisture-retentive cap units 141, 142. The nozzle rows 43 are capped with the moisture-retentive caps 144, thereby the liquids in the nozzles 44 are maintained in a moist environment.

Next, the maintenance unit 45 is described.

The maintenance unit 45 includes a suction cap unit 50, a flushing unit 60, a first suction unit 161, a second suction unit 162, and a wiping device 170. The first suction unit 161 has a slit-shaped third suction opening 163 extending in the transport direction Y. The second suction unit 162 has a slit-shaped fourth suction opening 164 extending in the transport direction Y. The first and second suction units 161, 162 are connected to a common collection box 80 (see FIG. 3) through respective tubes 165, 166.

In the maintenance unit 45, the flushing unit 60, the first suction unit 161, the wiping device 170, the second suction unit 162, and the suction cap unit 50 are arranged in this order from a portion of the maintenance unit 45 close to the image forming area FA in the width direction X.

The suction cap unit 50 includes a first suction cap unit 51 and a second suction cap unit 52 that can be respectively brought into contact with the first liquid ejecting head 26 and the second liquid ejecting head 27. The first and second suction cap units 51, 52 are disposed at different positions in the transport direction Y so as to correspond to the disposition of the first and second liquid ejecting heads 26, 27. In more detail, according to the present embodiment, the first suction cap unit 51 is disposed closer to the image forming area FA side than the second suction cap unit 52 in the width direction X and upstream of the second suction cap unit 52 in the transport direction Y. The suction cap unit 50 includes a suction cap motor 53 that operates the first and second suction cap units 51, 52. The first and second suction cap units 51, 52 are, by motive power of the suction cap motor 53, movable between contact positions where the first and second suction cap units 51, 52 are in contact with the first and second liquid ejecting heads 26, 27, respectively, and retracted positions where the first and second suction cap units 51, 52 are kept separated from the first and second liquid ejecting heads 26, 27, respectively.

The first and second suction cap units 51, 52 each include four suction caps 54. The nozzles 44 can be capped with the suction caps 54. Each pair of the nozzle rows 43 in which two nozzle rows 43 are closely arranged in the width direction X can be capped with a corresponding one of the suction caps 54. That is, eight nozzle rows 43 can be simultaneously capped with four suction caps 54 of a corresponding one of the first and second suction cap units 51, 52.

The suction caps 54 are connected to suction pumps 57 through suction tubes 56. The suction pumps 57 include, for example, tube pumps. When the suction pumps 57 are driven with the nozzles 44 capped with the suction caps 54, the liquids are sucked and discharged from the nozzles 44 due to negative pressure applied to the insides of the suction caps 54. Thus, thickened liquids, bubbles, or the like are discharged together with the liquids from the nozzles 44, and the nozzles 44 are cleaned. With the suction caps 54 according to the present embodiment, all the nozzle rows 43 can be collectively cleaned.

The wiping device 170 includes a cassette holder 171, a guide frame 172, and a holder driver 173. The cassette holder 171 can reciprocate in the transport direction Y. The guide frame 172 guides the cassette holder 171. The holder driver 173 moves the cassette holder 171. The wiping device 170 can wipe the nozzle forming surfaces 28, 29. A wiper cassette 174 and a liquid collector 175 arranged in the transport direction Y are removably mounted in the cassette holder 171.

The wiper cassette 174 includes a cloth sheet 176 that wipes the first and second liquid ejecting heads 26, 27. The cloth sheet 176 is a belt-shaped member wound into a roll shape. It is preferable that the cloth sheet 176 be an absorbing member that can absorb ink. When the wiper cassette 174 is moved together with the cassette holder 171, the cloth sheet 176 unwound from the roll wipes the first and second liquid ejecting heads 26, 27. The term "wiping" refers to a type of maintenance performed by wiping.

The liquid collector 175 receives the liquids ejected from the first and second liquid ejecting heads 26, 27 and the liquids discharged from the first and second liquid ejecting heads 26, 27 due to pressure cleaning. That is, the liquid collector 175 functions as an example of liquid receiving unit that can receive the liquids discharged from the liquid ejecting unit 14 due to the flushing being an example of a discharge operation for maintenance of the liquid ejecting unit 14 or the pressure cleaning being an example of the discharge operation. The liquids discharged due to the flushing can be also received by the cloth sheet 176. In this regard, the cloth sheet 176 functions as an example of the liquid receiving unit. In this case, the cloth sheet 176 having been used can receive the liquids. The third suction opening 163 and the fourth suction opening 164 are provided adjacent to the liquid collector 175 and the cloth sheet 176 in the width direction X.

The flushing unit 60 can receive the liquids ejected from the liquid ejecting unit 14 when the flushing being an example of the discharge operation is performed. In the flushing, the liquid ejecting unit 14 ejects the liquids not contributing to printing so as to suppress clogging of the nozzles 44 or the like. The liquid ejecting apparatus 11 according to the present embodiment checks an ejection state of the liquids ejected from the nozzles 44 when the flushing is performed. According to the present embodiment, this check is performed based on residual vibration of vibrating plates in a pressure chambers due to driving of actuators included in the first and second liquid ejecting heads 26, 27.

The device or the method of detecting discharge (ejection) anomalies of the nozzles 44 and the cause of the discharge anomalies in the liquid ejecting apparatus 11 is not limited to the method as described above in which vibration patterns of residual vibration of the vibrating plates are detected and analyzed. Variations of the method of detecting discharge anomalies include methods as described below. For example, there is the following method: Light such as laser light is directly radiated to and reflected at ink meniscuses in the nozzles and a vibration state of the meniscuses is detected by a light receiving element, thereby the cause of clogging is identified based on the vibration state. There also is the following method: The presence/absence of discharge anomalies is detected by using a generally used optical missing-dot detector that detects whether flying droplets enter a detection range of a sensor. After the discharging, in the case where discharge anomalies occur after a specified drying time during which missing dot may occur has elapsed, the cause of the discharge anomalies is assumed to be drying, and in the case where discharge anomalies occur before the above-described drying time elapses, the cause of discharge anomalies is assumed to be adherence of foreign matter or entrance of bubbles. There also is the following method: A vibration sensor is added to the above-described optical missing-dot detector so as to determine whether vibration with which bubbles may enter is applied before the occurrence of discharge anomalies. When such vibration is applied, the cause of the discharge anomalies is assumed to be entrance of bubbles. Furthermore, the device for detecting missing dot is not necessarily limited to that of the optical type. For example, any of detectors or methods described below may be used: a thermal sensitive detector that detects variation in temperature of a heat sensing portion caused by discharge of droplets; a detector that detects variation in amount of electrical charge of a detecting electrode to which electrically charged ink droplets are discharged and which is struck by these droplets; a detector that detects capacitance that varies due to passage of ink droplets between electrodes; and a method in which a camera or the like detects as image information check patterns formed by ejecting the liquids from the liquid ejecting heads to the medium ST or a receiving surface of the flushing unit 60. In addition, methods of detecting adherence of paper dust may include, for example, a method in which a camera or the like detects as image information a state of nozzle surfaces and a method that detects the presence/absence of adhering paper dust by scanning a region near the nozzle surfaces with an optical sensor such as a laser sensor.

Figure 3:
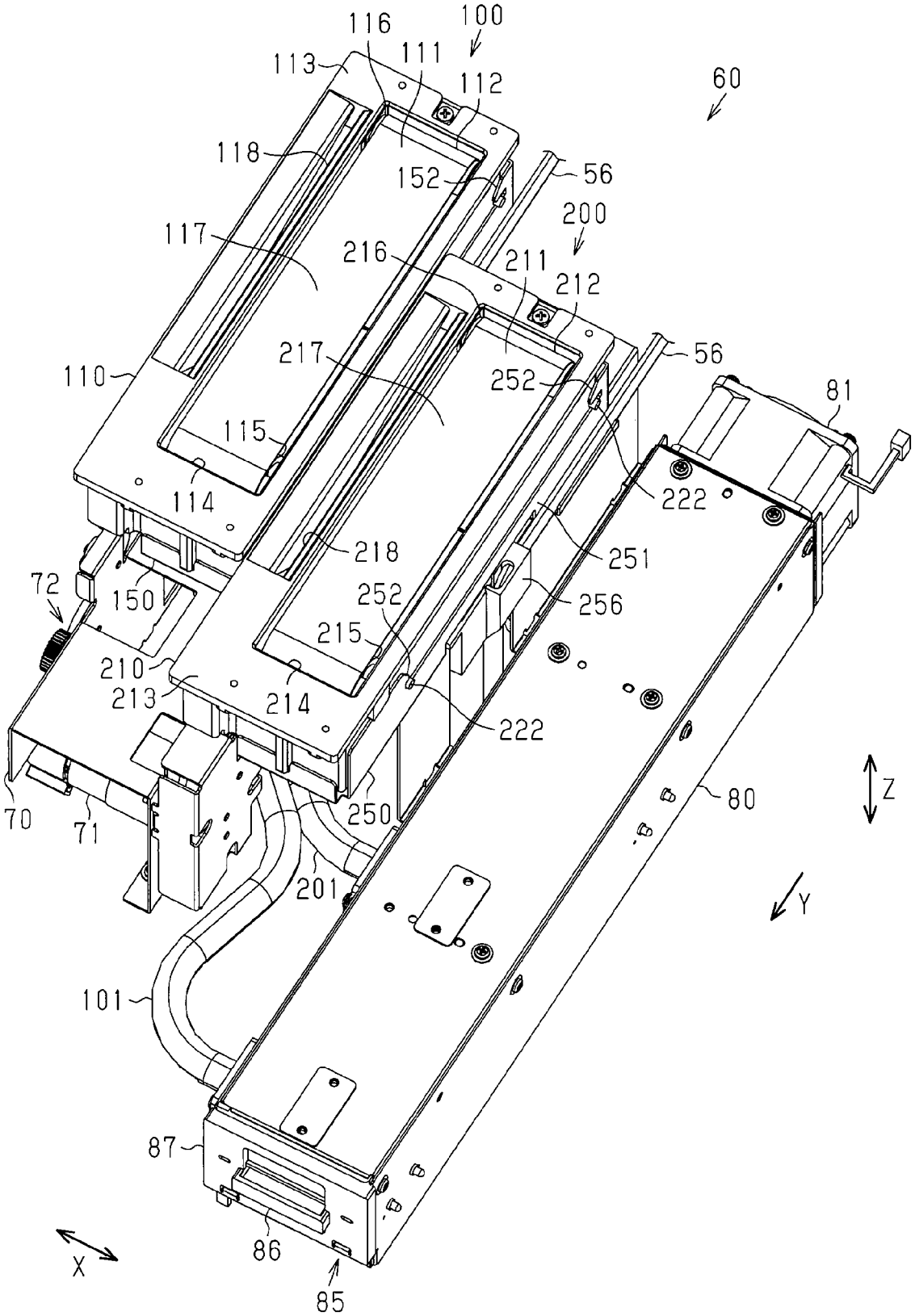
FIG. 3 is a perspective view of a flushing unit.

As illustrated in FIGS. 2 and 3, the flushing unit 60 includes a first receiving unit 100, a second receiving unit 200, a base table 70 that supports the first receiving unit 100 and the second receiving unit 200, and the collection box 80. The first receiving unit 100 can receive the first liquid ejected from the first liquid ejecting head 26 by the flushing. The second receiving unit 200 can receive the second liquid ejected from the second liquid ejecting head 27 by the flushing. The first receiving unit 100 and the second receiving unit 200 are disposed at different positions in the transport direction Y so as to respectively correspond to the arrangement of the first nozzle group 41 of the first liquid ejecting head 26 and the arrangement of the second nozzle group 42 of the second liquid ejecting head 27. According to the present embodiment, the first receiving unit 100 is disposed closer to the image forming area FA side than the second receiving unit 200 in the width direction X and upstream of the second receiving unit 200 in the transport direction Y. The first and second receiving units 100, 200 are connected to the common collection box 80 respective through tubes 101, 201.

The first receiving unit 100 includes a first rotation body 112 and a first rotation-body holder 110. The first rotation body 112 has a circumferential surface 111 that can receive the first liquid. The first rotation body 112 is mounted in the first rotation-body holder 110. The second receiving unit 200 includes a second rotation body 212 and a second rotation-body holder 210. The second rotation body 212 has a circumferential surface 211 that can receive the second liquid. The second rotation body 212 is mounted in the second rotation-body holder 210. That is, the first rotation body 112 is disposed closer to the image forming area FA side than the second rotation body 212 in the width direction X. According to the present embodiment, the first rotation body 112 and the second rotation body 212 each include a belt-shaped member such as, for example, a belt. The first rotation body 112 and the second rotation body 212 have widths that are larger than or equal to the widths of the first nozzle group 41 and the second nozzle group 42, respectively, in the width direction X. The first and second receiving units 100, 200 are respectively connected to suction tubes 56, 56 extending from the suction caps 54 of the first and second suction cap units 51, 52.

The first and second rotation-body holders 110, 210 have exposure openings 114, 214 at their respective upper surfaces 113, 213. The insides of the first and second rotation-body holders 110, 210 are exposed through the exposure openings 114, 214. Drive rollers 115, 215 and driven rollers 116, 216 are rotatably attached to the first and second rotation-body holders 110, 210. The drive rollers 115, 215 and the driven rollers 116, 216 are disposed in the first and second rotation-body holders 110, 210 so as to be partially exposed through the exposure openings 114, 214 when seen from above. The drive rollers 115, 215 and the driven rollers 116, 216 are spaced from one another with specified gaps therebetween in the transport direction Y. The drive rollers 115, 215 are disposed downstream of the driven rollers 116, 216 in the transport direction Y and have larger diameters than those of the driven rollers 116, 216.

The first and second rotation bodies 112, 212 are mounted in the first and second rotation-body holders 110, 210 while being looped over a plurality of rollers including the drive rollers 115, 215 and the driven rollers 116, 216. At this time, parts of the circumferential surfaces 111, 211 of the first and second rotation bodies 112, 212 are exposed through the exposure openings 114, 214. That is, the parts of the circumferential surfaces 111, 211 of the first and second rotation bodies 112, 212 exposed through the exposure openings 114, 214 serve as receiving surfaces 117, 217 that receive the first and second liquids. According to the present embodiment, the receiving surfaces 117, 217 extend so as to become horizontal surfaces. The first and second rotation bodies 112, 212 are disposed such that the receiving surfaces 117, 217 become parts of the upper surfaces 113, 213 of the first and second rotation-body holders 110, 210.

A drive source 71 that drives the drive rollers 115, 215 of the first and second receiving units 100, 200 is attached to the base table 70. The drive source 71 rotates the drive rollers 115, 215 of the first and second receiving units 100, 200 by using the drive force. The driven rollers 116, 216 are rotated due to the rotation of the drive rollers 115, 215 through the first and second rotation bodies 112, 212. That is, due to the rotation of the plurality of rollers including the drive rollers 115, 215 and the driven rollers 116, 216, the circumferential surfaces 111, 211 of the first and second rotation bodies 112, 212 are rotated so as to be moved around the plurality of rollers. At this time, the first and second rotation bodies 112, 212 according to the present embodiment are rotated around the rollers such that the receiving surfaces 117, 217 that receive the liquids are moved toward the upstream side in the transport direction Y. That is, the first rotation body 112 is rotated in the direction separating from the second rotation body 212 in the transport direction Y.

In other words, the first and second rotation bodies 112, 212 are rotated so that regions having received the liquids having been used for the flushing are separated from the optical machine 40. Thus, mists (airborne droplets) caused due to the flushing can be guided in the direction separating from the optical machine 40.

The first rotation-body holder 110 has a first suction opening 118 having a slit shape and extending in the transport direction Y. In the first rotation-body holder 110, the first suction opening 118 is disposed on the image forming area FA side relative to the position where the first rotation body 112 is provided. In other words, the first suction opening 118 is positioned between the image forming area FA and the first rotation body 112 in the width direction X.

The second rotation-body holder 210 has a second suction opening 218 having a slit shape and extending in the transport direction Y. In the second rotation-body holder 210, the second suction opening 218 is disposed on the image forming area FA side relative to the position where the second rotation body 212 is provided. In other words, the second suction opening 218 is positioned between the first rotation body 112 and the second rotation body 212 in the width direction X.

According to the present embodiment, a suction mechanism 160 is constituted by the first and second receiving units 100, 200, the first and second suction units 161 and 162, and the collection box 80. The suction mechanism 160 has first, second, third, and fourth suction openings 118, 218, 163, 164 from which ambient air can be sucked. The first, second, third, and fourth suction openings 118, 218, 163, 164 are directed upward so that these suction openings can face the liquid ejecting unit 14. Accordingly, ambient air existing on the liquid ejecting unit 14 side relative to the first, second, third, and fourth suction openings 118, 218, 163, 164 in the vertical direction Z can be sucked from the first, second, third, and fourth suction openings 118, 218, 163, 164. The first, second, third, and fourth suction openings 118, 218, 163, 164, the first rotation body 112, the second rotation body 212, the liquid collector 175, and the cloth sheet 176 are provided in the maintenance area MA. The suction mechanism 160 may suck the ambient air from all of the first, second, third, and fourth suction openings 118, 218, 163, 164 or from at least one of the openings selected from the first, second, third, and fourth suction openings 118, 218, 163, 164.

In the width direction X, the first and second suction openings 118, 218 are provided adjacent to the first rotation body 112 exemplifying the liquid receiving unit. In the width direction X, the second and third suction openings 218, 163 are provided adjacent to the second rotation body 212 exemplifying the liquid receiving unit.

The collection box 80 includes a suction fan 81 at an upstream end portion in the transport direction Y. The suction fan 81 performs suction on the inside of the collection box 80. That is, the suction fan 81 is driven so as to perform exhaustion from the inside toward the outside of the collection box 80. The inside of the collection box 80 and the first and second suction openings 118, 218 of the first and second rotation-body holders 110, 210 communicate with one another through the tubes 101, 201. The first and second suction units 161 and 162 communicate with the inside of the collection box 80 through the tubes 165, 166. That is, when the suction fan 81 is driven, ambient air in a space facing the first and second rotation-body holders 110, 210 is sucked from the first and second suction openings 118, 218 through the tubes 101, 201 and the collection box 80. Also, when the suction fan 81 is driven, ambient air in a space facing the first and second suction units 161 and 162 is sucked from the third and fourth suction openings 163, 164 through the tubes 165, 166 and the collection box 80.

When the liquid ejecting unit 14 performs the flushing, due to ejection of the first and second liquids toward the first and second rotation bodies 112, 212, mists that are atomized sprays of the first and second liquids may be generated. The mists may also be generated when the first and second liquid ejecting heads 26, 27 eject the first and second liquids toward the liquid collector 175 or the cloth sheet 176 or when the first and second liquids are discharged due to the pressure cleaning. The first, second, third, and fourth suction openings 118, 218, 163, 164 are openings for sucking the mists of the first and second liquids. The first suction opening 118 is mainly used to suck the mist of the first liquid. The second suction opening 218 is mainly used to suck the mist of the second liquid. The third and fourth suction openings 163, 164 are used to suck the mists of the first and second liquids. Such mists of the first and second liquids are also generated when printing is performed on the medium ST in the image forming area FA. The mists of the first and second liquids sucked from the first, second, third, and fourth suction openings 118, 218, 163, 164 are collected in the collection box 80.

Next, specific structures of the first receiving unit 100 and the second receiving unit 200 are described.

Figure 4:
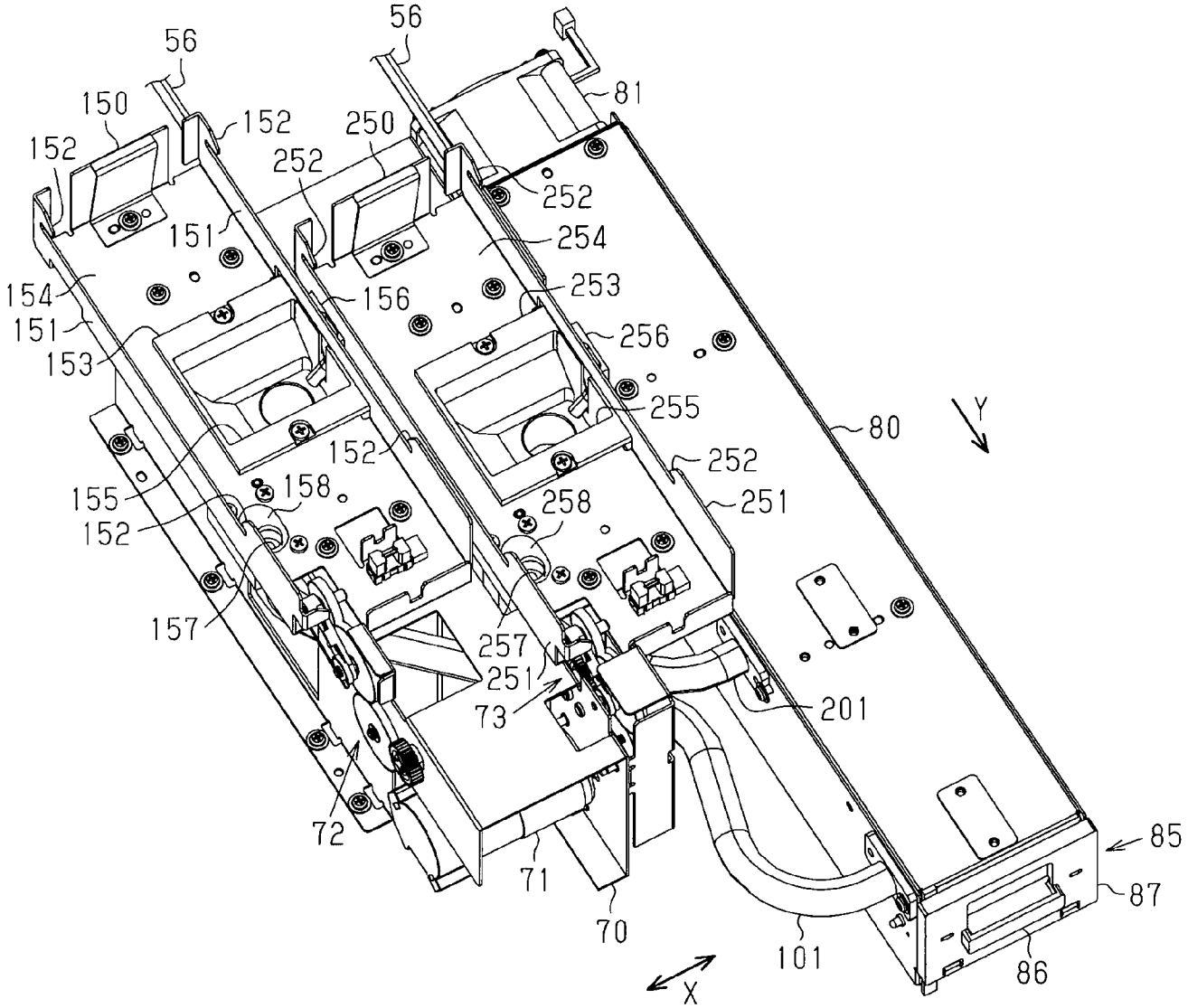
FIG. 4 is perspective view of a first mounting portion and a second mounting portion.

As illustrated in FIGS. 3 and 4, the first and second receiving units 100, 200 are integrally attached to the base table 70. The base table 70 is positioned immediately below the first receiving unit 100. The base table 70 includes, in addition to the drive source 71, transmission mechanisms 72, 73 that transmit the drive force of the drive source 71. The transmission mechanisms 72, 73 include a plurality of members such as gears, pulleys, and belts. The transmission mechanisms 72, 73 are separately provided on both sides of the base table 70 in the width direction X. The transmission mechanism 72 disposed close to the image forming area FA in the width direction X transmits the drive force of the drive source 71 to the drive roller 115 of the first rotation-body holder 110. The transmission mechanism 73 disposed on the opposite side to the transmission mechanism 72, that is, close to the second receiving unit 200 in the width direction X transmits the drive force of the drive source 71 to the drive roller 215 of the second rotation-body holder 210. The transmission mechanisms 72, 73 are driven in synchronization with each other. Thus, the first and second rotation bodies 112, 212 are rotated in synchronization with each other when the drive source 71 is driven.

The first receiving unit 100 includes a first mounting portion 150 in which the first rotation-body holder 110 is removably mounted. The second receiving unit 200 includes a second mounting portion 250 in which the second rotation-body holder 210 is removably mounted. The first and second mounting portions 150, 250 are frames having openings at their respective tops. The first mounting portion 150 has claws 152 at its side walls 151 on both sides thereof in the width direction X for mounting the first rotation-body holder 110. The second mounting portion 250 has claws 252 at its side walls 251 on both sides thereof in the width direction X for mounting the second rotation-body holder 210. The claws 152 are provided at an upstream position and a downstream position in the transport direction Y in each of the side walls 151 on a corresponding one of the sides of the first mounting portion 150. The claws 252 are provided at an upstream position and a downstream position in the transport direction Y in each of the side walls 251 on a corresponding one of the sides of the second mounting portion 250. That is, according to the present embodiment, the first mounting portion 150 has a total of four claws 152, and the second mounting portion 250 has a total of four claws 252.

The first mounting portion 150 includes a first collector 153 that collects the first liquid ejected to the first rotation body 112. That is, the first mounting portion 150 is structured with the first collector 153 included therein. The second mounting portion 250 includes a second collector 253 that collects the second liquid ejected to the second rotation body 212. That is, the second mounting portion 250 is structured with the second collector 253 included therein. The first and second collectors 153, 253 are containers in which the first and second liquids can be collected. The first and second collectors 153, 253 are disposed so as to be fitted into bottom walls 154, 254 of the first and second mounting portions 150, 250. The first and second collectors 153, 253 have respective collection openings 155, 255 that are open at the tops. The first and second collectors 153, 253 are attached to the bottom walls 154, 254 of the first and second mounting portions 150, 250 such that the collection openings 155, 255 thereof extend along the bottom walls 154, 254. The first and second collectors 153, 253 are secured to the bottom walls 154, 254 of the first and second mounting portions 150, 250 at the edges of the collection openings 155, 255 such that the first and second collectors 153, 253 are recessed downward from the bottom walls 154, 254 of the first and second mounting portions 150, 250.

The first collector 153 includes a connecting portion 156 to which one of the suction tubes 56 extending from the suction cap 54 of the first suction cap unit 51 is connected. This suction tube 56 extends along one of the side walls 151 of the first mounting portion 150 on the second receiving unit 200 side in the width direction X. The second collector 253 includes a connecting portion 256 to which the other suction tube 56 extending from the suction cap 54 of the second suction cap unit 52 is connected. The other suction tube 56 extends along one of the side walls 251 of the second mounting portion 250 on the collection box 80 side in the width direction X. Distal ends of these suction tubes 56, 56 are respectively introduced into the collection openings 155, 255 of the first and second collectors 153, 253 through the side walls 151, 251 of the first and second mounting portions 150, 250 and connecting portions 156, 256 of the first and second collectors 153, 253. That is, the first and second liquids sucked by the suction pumps 57, 57 of the first and second suction cap units 51, 52 are respectively collected in the first and second collectors 153, 253 through the suction tubes 56, 56.

The first and second mounting portions 150, 250 have connecting openings 157, 257 to which the tubes 101, 201 extending from the collection box 80 are connected. The connecting openings 157, 257 are open in the bottom walls 154, 254 of the first and second mounting portions 150, 250. The tubes 101, 201 are connected to the lower sides of the connecting opening 157, 257, that is, at positions near the base table 70. The first and second mounting portions 150, 250 include sealing members 158, 258 that are fitted into the bottom walls 154, 254 of the first and second mounting portions 150, 250 so as to surround the connecting openings 157, 257. The sealing members 158, 258 are formed of an elastic material such as, for example, rubber.

Next, the first rotation-body holder 110 and the second rotation-body holder 210 are described.

Figure 5:
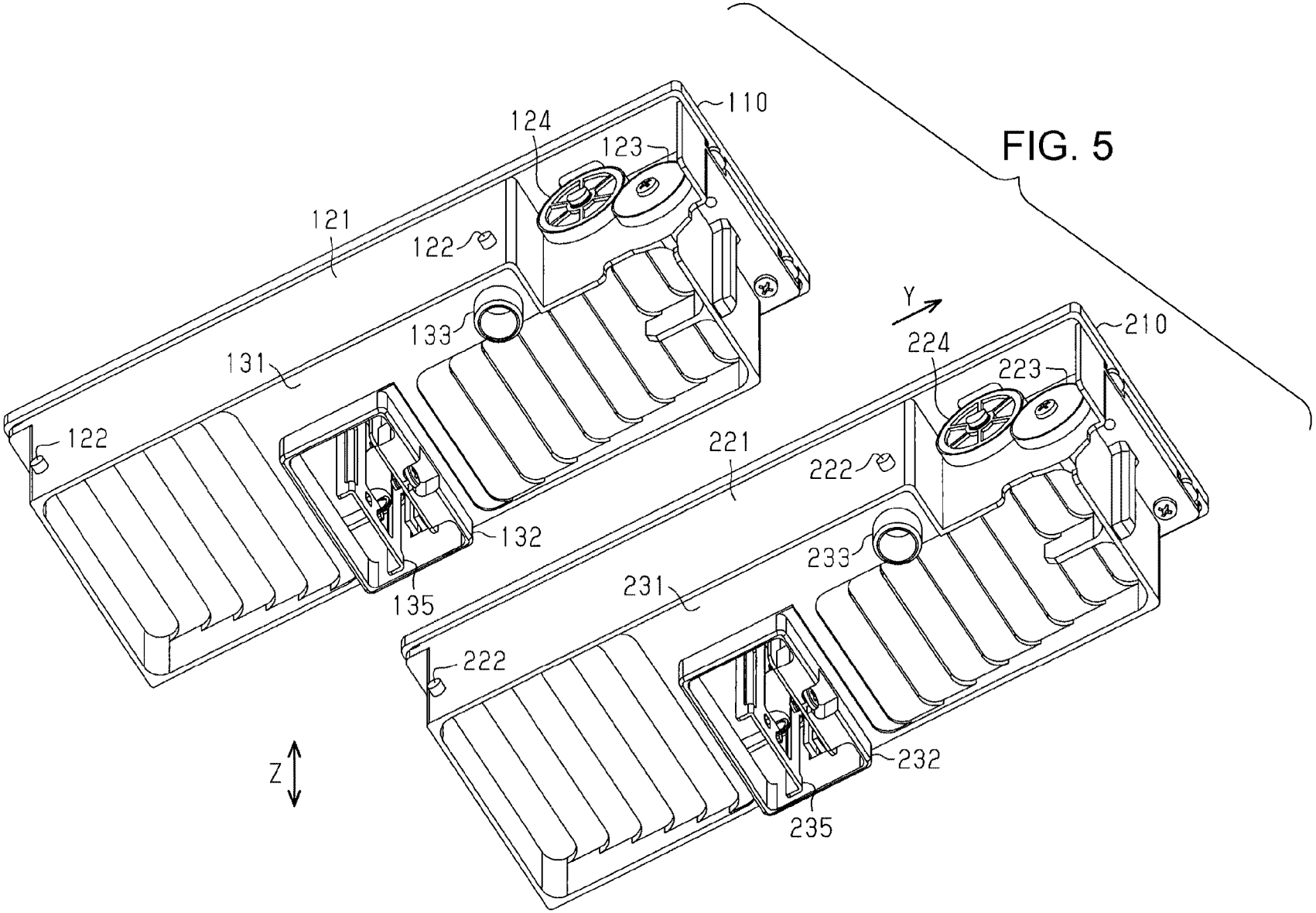
FIG. 5 is a perspective view of a first rotation-body holder and a second rotation-body holder.
Figure 6:
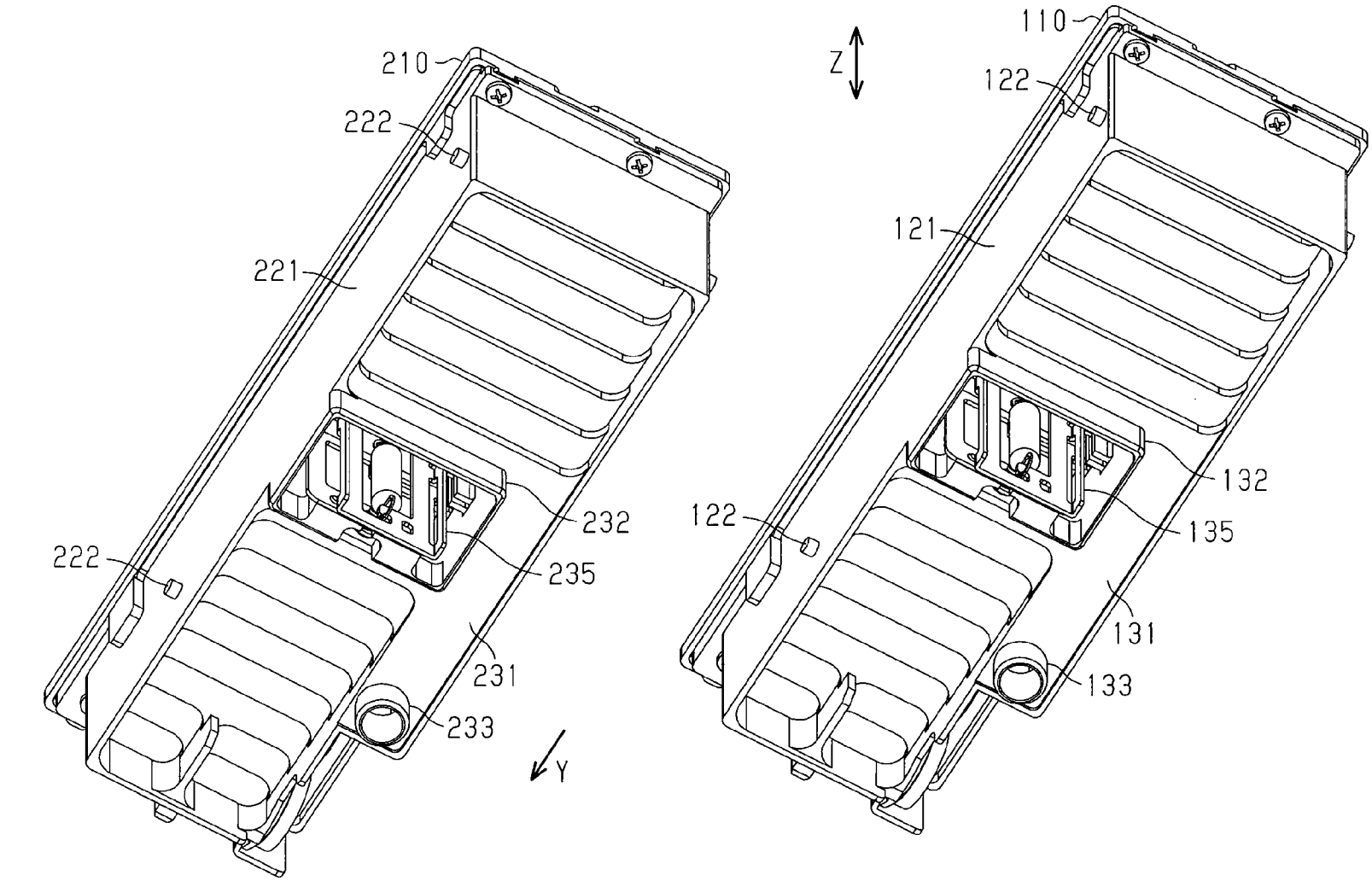
FIG. 6 is a perspective view of the first rotation-body holder and the second rotation-body holder.

As illustrated in FIGS. 5 and 6, the first and second rotation-body holders 110, 210 each have a box shape. Bosses 122 engageable with the claws 152 of the first mounting portion 150 are provided at both side surfaces 121 extending in the transport direction Y in the first rotation-body holder 110. Bosses 222 engageable with the claws 252 of the second mounting portion 250 are provided at both side surfaces 221 extending in the transport direction Y in the second rotation-body holder 210. The bosses 122, 222 project from the side surfaces 121, 221 in a columnar shape. A total of four bosses 122 are provided, corresponding to the claws 152 of the first mounting portion 150. A total of four bosses 222 are provided, corresponding to the claws 252 of the second mounting portion 250.

The first and second rotation-body holders 110, 210 include downstream gears 123, 223 disposed on one of the side surfaces 121 and one of the side surfaces 221 close to the image forming area FA in the width direction X. The downstream gears 123, 223 are engaged with upstream gears 124, 224. The downstream gears 123, 223 and the upstream gears 124, 224 are attached to downstream sides of the side surfaces 121, 221 in the transport direction Y that coincides with the longitudinal direction of the side surfaces 121, 221. The downstream gears 123, 223 are brought into engagement with the transmission mechanisms 72, 73 when the first and second rotation-body holders 110, 210 are mounted on the first and second mounting portions 150, 250. The upstream gears 124, 224 are rotatable in synchronization with the drive rollers 115, 215. That is, when the first and second rotation-body holders 110, 210 are mounted on the first and second mounting portions 150, 250, the downstream gears 123, 223 and the upstream gears 124, 224 transmit to the drive rollers 115, 215 the drive force of the drive source 71 having been transmitted from the transmission mechanisms 72, 73.

Rectangular outlets 132, 232 are open in lower surfaces 131, 231 of the first and second rotation-body holders 110, 210. The outlets 132, 232 project in a cylindrical shape downward from the lower surfaces 131, 231 and are provided near the centers in the transport direction Y. The outlets 132, 232 communicate with the exposure openings 114, 214 through the insides of the first and second rotation-body holders 110, 210. The outlets 132, 232 face the collection openings 155, 255 of the first and second collectors 153, 253 when the first and second rotation-body holders 110, 210 are mounted on the first and second mounting portions 150, 250.

Also, circular inlets 133, 233 are open in the lower surfaces 131, 231 of the first and second rotation-body holders 110, 210. The inlets 133, 233 project in a cylindrical shape downward from the lower surfaces 131, 231 and are provided on the downstream side in the transport direction Y. The inlets 133, 233 communicate with the first and second suction openings 118, 218 through the insides of the first and second rotation-body holders 110, 210. When the first and second rotation-body holders 110, 210 are mounted on the first and second mounting portions 150, 250, distal ends of the inlets 133, 233 are brought into contact with the sealing members 158, 258 provided at the bottom walls 154, 254 of the first and second mounting portions 150, 250. That is, when the first and second rotation-body holders 110, 210 are mounted on the first and second mounting portions 150, 250, the inlets 133, 233 communicate with the connecting opening 157, 257 of the first and second mounting portions 150, 250 in a sealed state.

Figure 7:
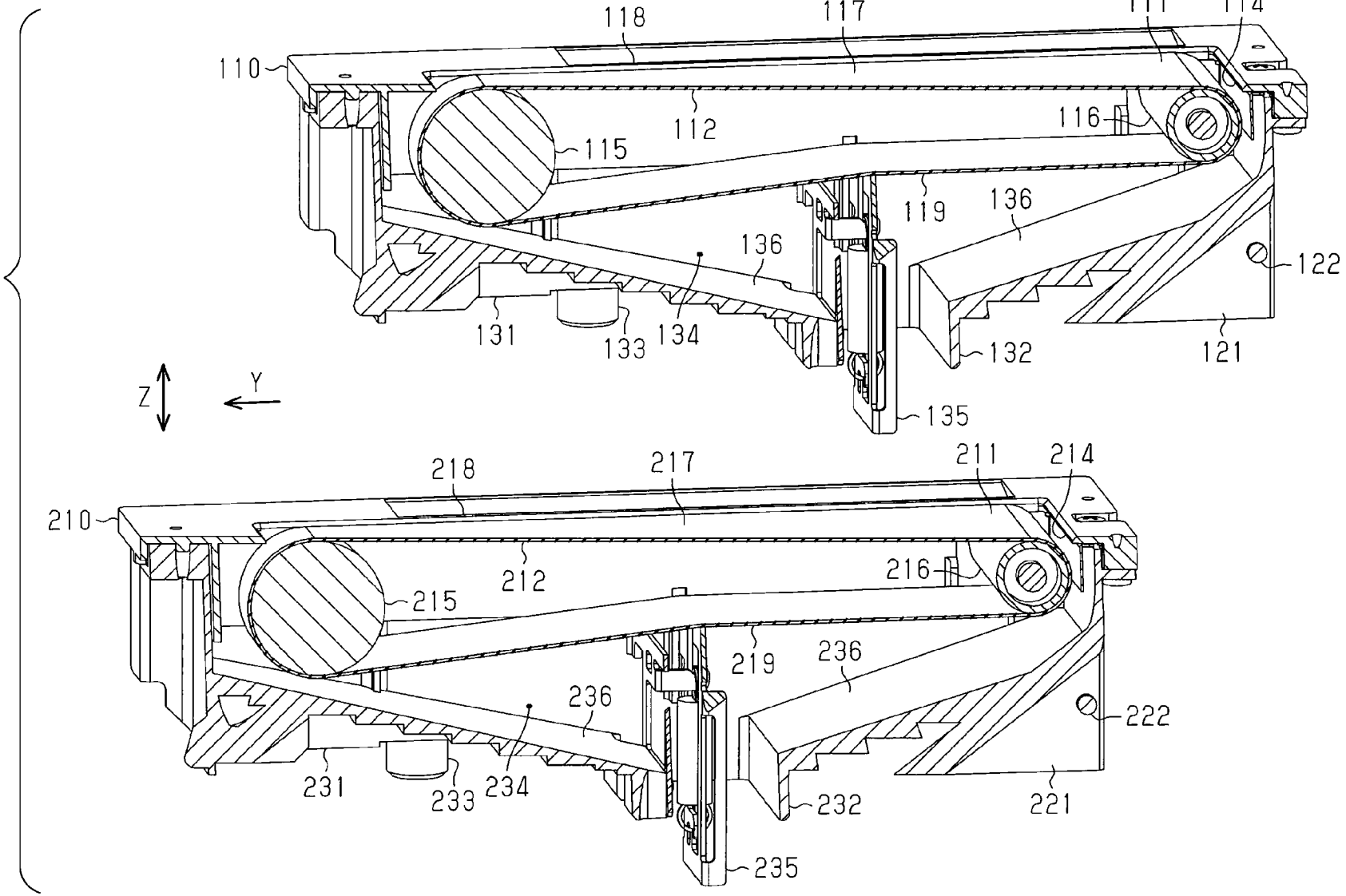
FIG. 7 is a perspective sectional view of the first rotation-body holder and the second rotation-body holder.

As illustrated in FIG. 7, the first and second rotation-body holders 110, 210 have containing chambers 134, 234 at which the exposure openings 114, 214 and the outlets 132, 232 are open. The containing chamber 134 of the first rotation-body holder 110 contains the drive roller 115, the driven roller 116, the first rotation body 112, and a first sliding member 135. The containing chamber 234 of the second rotation-body holder 210 contains the drive roller 215, the driven roller 216, the second rotation body 212, and a second sliding member 235. The first and second sliding members 135 and 235 each include a plate-shaped member such as, for example, a scraper. The first and second sliding members 135, 235 extend in the vertical direction Z and are held by the first and second rotation-body holders 110, 210 such that parts of the first and second sliding members 135, 235 on the lower sides project from the outlets 132, 232. The parts of the first and second sliding members 135, 235 on the lower sides enter the collection openings 155, 255 of the first and second collectors 153, 253 when the first and second rotation-body holders 110, 210 are mounted on the first and second mounting portions 150, 250.

Distal end portions of the first and second sliding members 135, 235 on the upper sides are in contact with the circumferential surfaces 111, 211 of the first and second rotation bodies 112, 212. According to the present embodiment, the first and second sliding members 135, 235 are in contact with the first and second rotation bodies 112, 212 looped over the drive rollers 115, 215 and the driven rollers 116, 216 so as to apply a small amount of tension to the first and second rotation bodies 112, 212. The first and second sliding members 135, 235 are in contact with scraping surfaces 119, 219 of the circumferential surfaces 111, 211 of the first and second rotation bodies 112, 212 opposite to, in the vertical direction Z, the receiving surfaces 117, 217 exposed through the exposure openings 114, 214. The scraping surfaces 119, 219 are inclined compared to the receiving surfaces 117, 217 being horizontal surfaces. When the first and second rotation bodies 112, 212 are rotated, the first and second sliding members 135, 235 are brought into sliding contact with the circumferential surfaces 111, 211 of the first and second rotation bodies 112, 212.

Since the first and second sliding members 135, 235 are in sliding contact with the circumferential surfaces 111, 211 of the first and second rotation bodies 112, 212, when the first and second rotation bodies 112, 212 are rotated while the first and second liquids adhere to the circumferential surfaces 111, 211 due to the flushing, the first and second liquids adhering to the circumferential surfaces 111, 211 are scraped off form the circumferential surfaces 111, 211. The first and second liquids scraped off and collected by the first and second sliding members 135, 235 flow along the first and second sliding members 135, 235, flow down through the outlets 132, 232, and are collected in the first and second collectors 153, 253 of the first and second mounting portions 150, 250. At this time, the circumferential surfaces 111, 211 of the first and second rotation bodies 112, 212 from which the first and second liquids have been scraped off are refreshed by the first and second sliding members 135, 235 from a state in which the first and second liquids adhere to the circumferential surfaces 111, 211 to a state in which the first and second liquids do not adhere to the circumferential surfaces 111, 211.

Bottom surfaces 136, 236 of the containing chambers 134, 234 are inclined in the transport direction Y so as to form a funnel shape toward the outlets 132, 232. That is, in the containing chambers 134, 234, the liquids dripped from the circumferential surfaces 111, 211 of the first and second rotation bodies 112, 212 flow along the bottom surfaces 136, 236, flow down through the outlets 132, 232, and is collected in the first and second collectors 153, 253. The insides of the containing chambers 134, 234 are maintained in a moist environment with the first and second liquids collected in the first and second collectors 153, 253.

Figure 8:
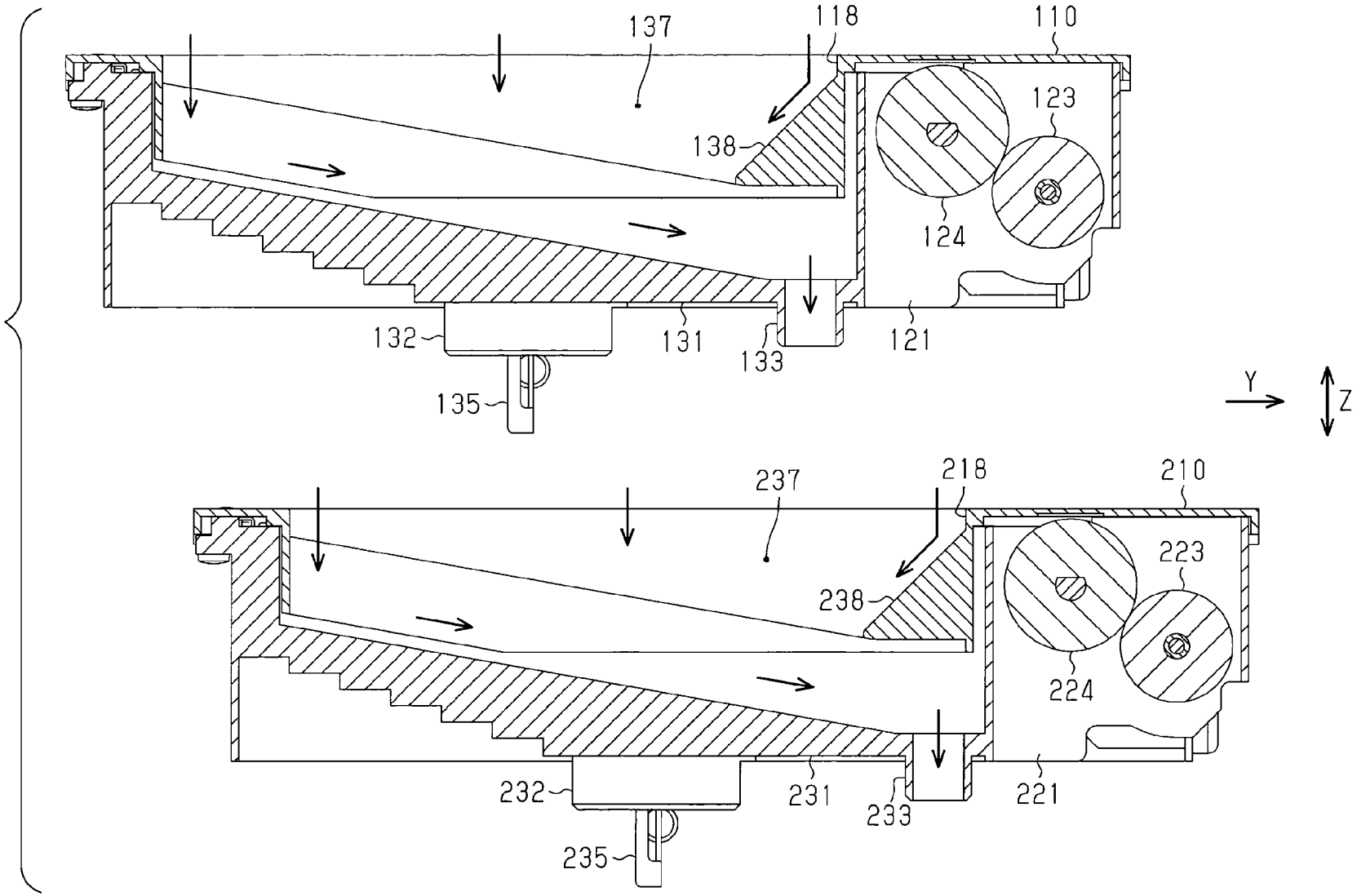
FIG. 8 is a side sectional view of the first rotation-body holder and the second rotation-body holder.

As illustrated in FIG. 8, the first and second rotation-body holders 110, 210 have suction chambers 137, 237 at which the first and second suction openings 118, 218 and the inlets 133, 233 are open. The suction chambers 137, 237 are separated from the containing chambers 134, 234 and provided as different spaces from the containing chambers 134, 234. The first and second rotation-body holders 110, 210 include blocking members 138, 238 in the suction chambers 137, 237. The blocking members 138, 238 are disposed directly above the respective inlets 133, 233. As indicated by arrows in FIG. 8, the blocking members 138, 238 perform blocking so as not to directly suck gas from positions on the downstream sides of the first and second suction openings 118, 218 in the transport direction Y. Without the blocking members 138, 238, suction forces are increased on the downstream sides of the first and second suction openings 118, 218 in the transport direction Y, that is, near the inlets 133, 233. This causes variation in suction force in the first and second suction openings 118, 218. In order to address this, in the liquid ejecting apparatus 11 according to the present embodiment, the blocking members 138, 238 are provided in the suction chambers 137, 237 so as to equalize the suction forces in the first and second suction openings 118, 218.

Next, the collection box 80 is described.

Figure 9:
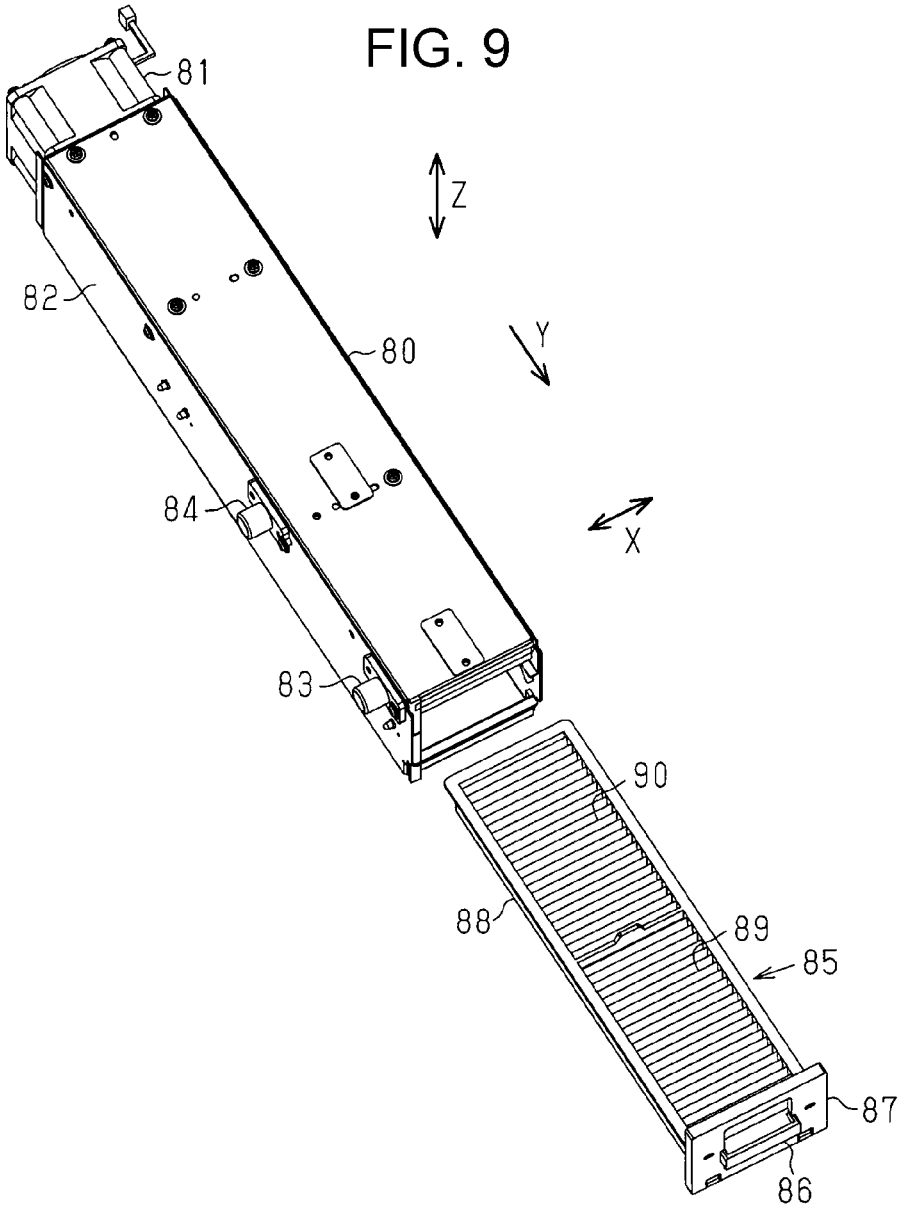
FIG. 9 is a perspective view of a collection box.
Figure 10:
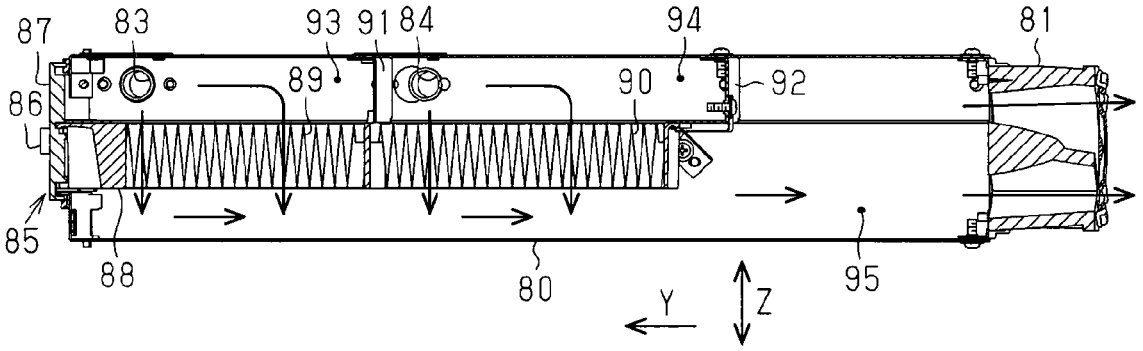
FIG. 10 is a sectional view of the collection box.

As illustrated in FIGS. 9 and 10, the collection box 80 includes a cylindrical first connecting pipe 83 and a cylindrical second connecting pipe 84 in a side surface 82 that extends in the transport direction Y coincident with the longitudinal direction of the collection box 80 and that is close to the image forming area FA in the width direction X. The tubes 101, 201 are connected to the first connecting pipe 83 and the second connecting pipe 84. The collection box 80 also includes connecting pipes (not illustrated) to which the tubes 165, 166 are connected. The first and second connecting pipes 83, 84 and the connecting pipes (not illustrated) allow communication between the inside and outside of the collection box 80. The collection box 80 includes a filter cassette 85 removably attached to the collection box 80. The filter cassette 85 can be inserted into/removed from the collection box 80 from the downstream side in the transport direction Y. The filter cassette 85 includes a front plate 87 having a handle 86 and a frame 88 extending from the front plate 87. The filter cassette 85 also includes a first filter member 89 and a second filter member 90 that are attached to the frame 88. The first and second filter members 89, 90 each have a bellows shape. The first and second filter members 89, 90 are formed of the same material. The frame 88 holds the first filter member 89 and the second filter member 90 in this order from the downstream side to the upstream side in the transport direction Y.

The inside of the collection box 80 is separated into a plurality of spaces by a plurality of separators 91, 92. The collection box 80 has therein a first compartment 93 at which the first connecting pipe 83 is open, a second compartment 94 at which the second connecting pipe 84 is open, and a common chamber 95 continuous with the first compartment 93 and the second compartment 94. The common chamber 95 communicates with the suction fan 81. When the filter cassette 85 is mounted in the collection box 80, the common chamber 95 is separated from the first compartment 93 by the first filter member 89 and separated from the second compartment 94 by the second filter member 90. That is, the mists of the first and second liquids sucked from the first and second suction openings 118, 218 by the suction fan 81 and guided to the first and second compartments 93 and 94 are, as indicated by arrows in FIG. 10, collected by the first and second filter members 89, 90. Gas sucked from the first and second suction openings 118, 218 together with the mists is, as indicated by arrows in FIG. 10, exhausted from the common chamber 95 to the outside of the collection box 80 through the suction fan 81.

Next, a cover member 47 is described.

Figure 11:
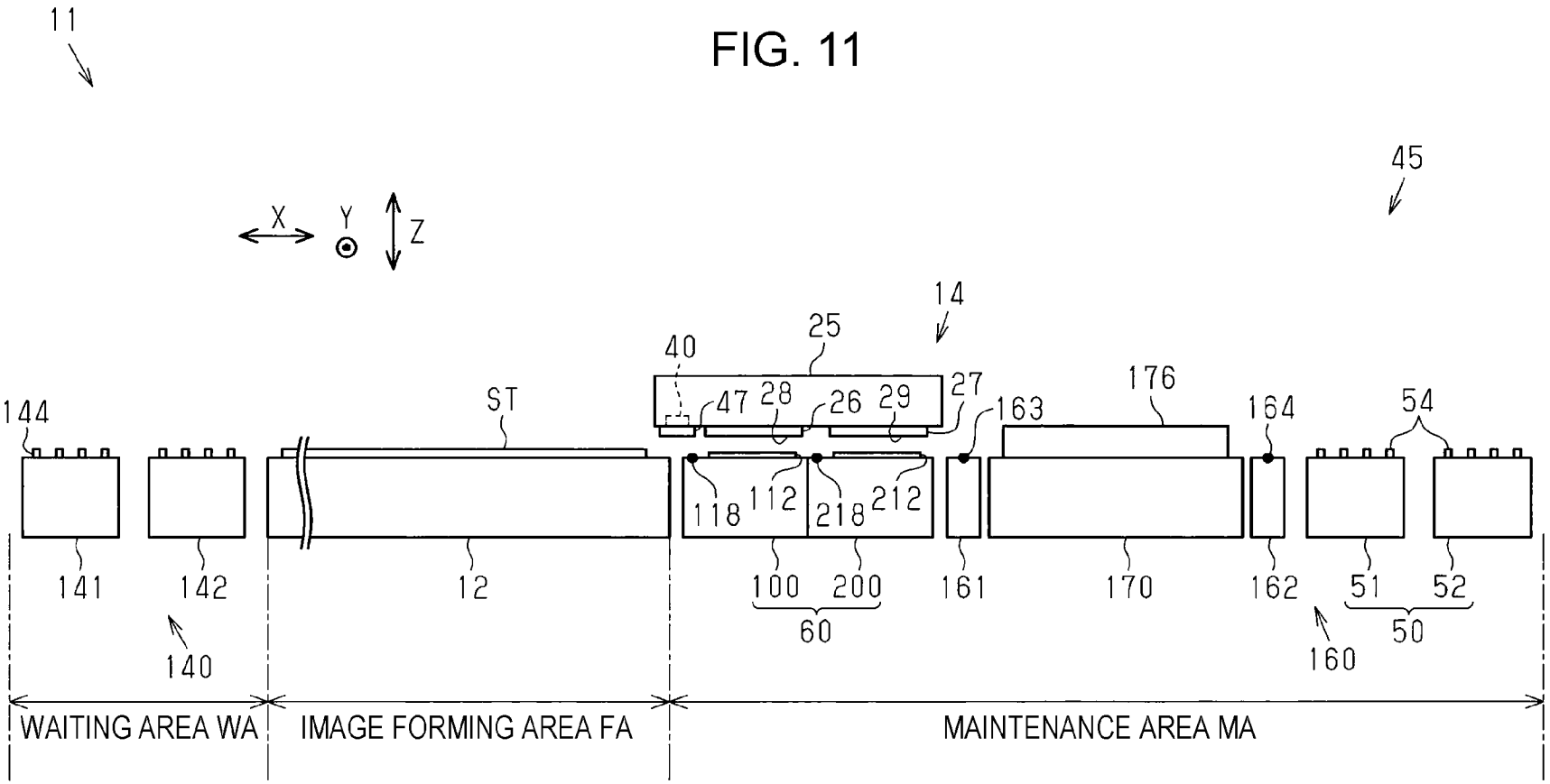
FIG. 11 is a front view schematically illustrating part of the liquid ejecting apparatus during flushing.

As illustrated in FIG. 11, the liquid ejecting apparatus 11 includes the cover member 47 provided closer to a portion facing the medium ST than the optical machine 40. The cover member 47 is formed of a transparent material such as colorless transparent glass or resin. The optical machine 40 may detect light having been transmitted through the cover member 47 or cause light radiated therefrom to be transmitted through the cover member 47.

The cover member 47 is positioned so as to interfere with the cloth sheet 176 in the vertical direction Z. That is, the cover member 47 is provided at a position where the wiping device 170 can wipe the cover member 47. The lower surface of the cover member 47 that can be wiped by the cloth sheet 176 may be disposed at the same position as or a different position from the nozzle forming surfaces 28, 29 in the vertical direction Z. For example, the position of the lower surface of the cover member 47 may be kept further separated from the support table 12 than the nozzle forming surfaces 28, 29 in the vertical direction Z.

Next, operation of the liquid ejecting apparatus 11 having the above-described structure is described.

When the liquid ejecting unit 14 can eject the first and second liquids having different properties, the first and second liquids may chemically react to each other depending on the types of the liquids. For example, according to the present embodiment, the first liquid is a treatment liquid that enhances fixing of the second liquid. Thus, reaction between the first and second liquids enhances the fixing of the second liquid due to the effect of the first liquid. In this case, when both the first and second liquids adhere to the circumferential surfaces of the rotation bodies subjected to the liquids ejected by the flushing, the second liquid is fixed to the circumferential surfaces of the rotation bodies. When the liquid is fixed to the circumferential surfaces of the rotation bodies, rotational operation of the rotation bodies fails due to accumulation of the liquids on the circumferential surfaces. This increases the difficulty in favorably performing the flushing. In order to address this, according to the present embodiment, the collectors are each provided for a corresponding one of types of the liquids ejected by the liquid ejecting unit 14. That is, when the liquid ejecting unit 14 performs the flushing, the first liquid is ejected to the first rotation body 112 and the second liquid is ejected to the second rotation body 212. This reduces the possibility of the first and second liquids mixing on the circumferential surfaces 111, 211 of the first and second rotation bodies 112, 212.

When the liquid ejecting unit 14 performs the flushing, the first and second liquids adhere to the circumferential surfaces 111, 211 of the first and second rotation bodies 112, 212 while the rotation of the first and second rotation bodies 112, 212 is stopped. After the liquid ejecting unit 14 has performed the flushing, the first and second rotation bodies 112, 212 are rotated, thereby the first and second liquids are scraped off from the circumferential surfaces 111, 211 by the first and second sliding members 135, 235 and collected in the first and second collectors 153, 253.

Figure 12:
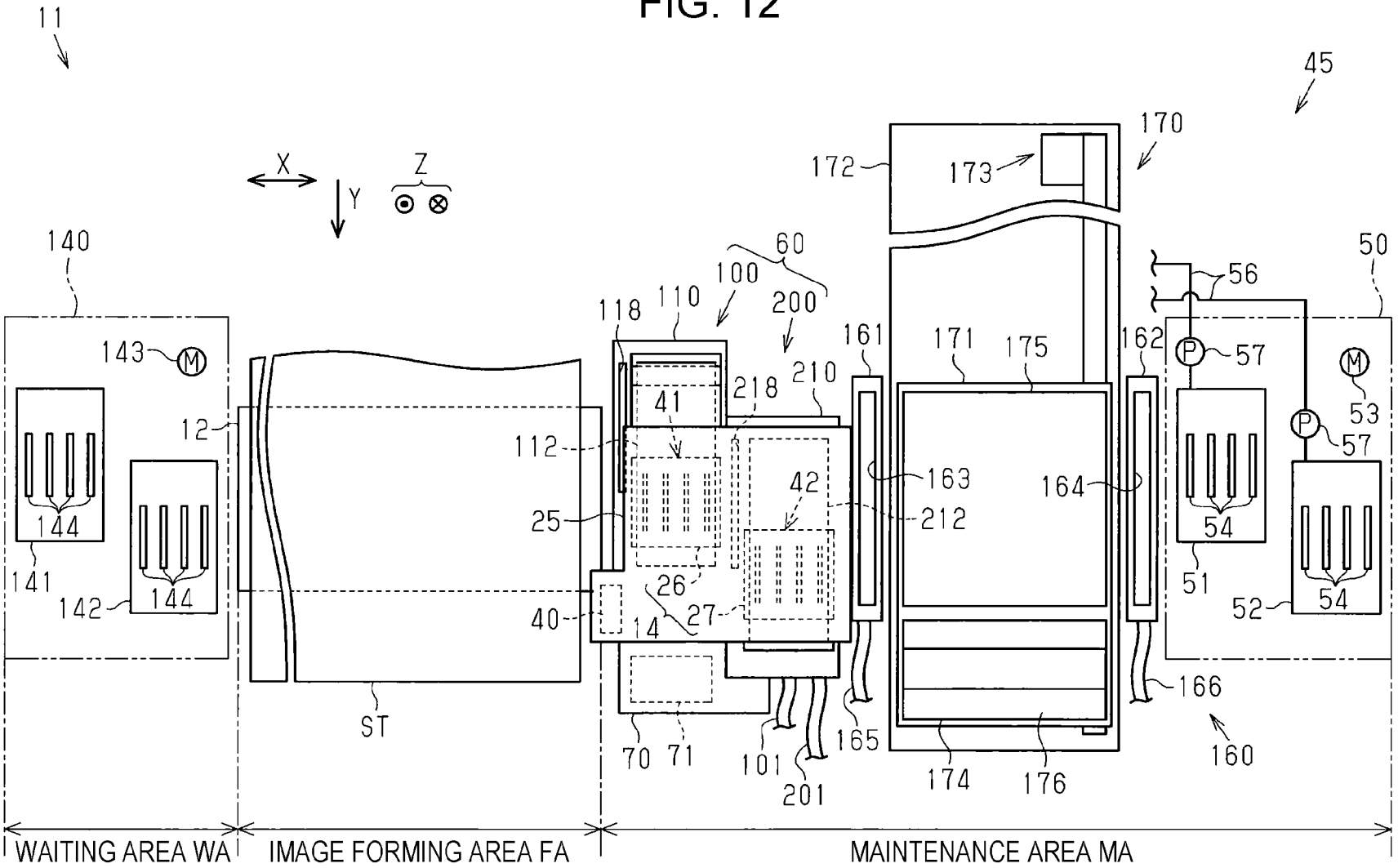
FIG. 12 is a top view schematically illustrating the part of the liquid ejecting apparatus during the flushing.

The liquid ejecting apparatus 11 causes the suction mechanism 160 to operate during operation of the flushing or pressure cleaning so as to suck the ambient air. As illustrated in FIGS. 11 and 12, during the flushing in which the first liquid ejecting head 26 faces the first rotation body 112 and ejects the first liquid from the first nozzle group 41, the first, second, third, and fourth suction openings 118, 218, 163, 164 are on the first rotation body 112 side relative to the optical machine 40 in the width direction X. More specifically, during the flushing, the first suction opening 118 is positioned between the optical machine 40 and the first rotation body 112 in the width direction X. The second, third, and fourth suction openings 218, 163, 164 are kept further separated from the optical machine 40 than the first rotation body 112 in the width direction X. At this time, the liquid ejecting apparatus 11 may cause the suction mechanism 160 to operate so as to suck the ambient air from all the suction openings 118, 218, 163, 164 or the selected suction opening or openings out of the suction openings 118, 218, 163, 164.

During the flushing in which the second liquid ejecting head 27 faces the second rotation body 212 and ejects the second liquid from the second nozzle group 42, the first, second, third, and fourth suction openings 118, 218, 163, 164 are on the second rotation body 212 side relative to the optical machine 40 in the width direction X. More specifically, during the flushing, the first and second suction openings 118, 218 are positioned between the optical machine 40 and the second rotation body 212 in the width direction X. The third and fourth suction openings 163, 164 are kept further separated from the optical machine 40 than the second rotation body 212 in the width direction X.

At this time, the liquid ejecting apparatus 11 may cause the suction mechanism 160 to operate so as to suck the ambient air from all the suction openings 118, 218, 163, 164, or the liquid ejecting apparatus 11 may cause the suction mechanism 160 to operate so as to suck the ambient air from the second and third suction openings 218, 163 disposed on both the sides of the second rotation body 212. The liquid ejecting apparatus 11 may select the suction openings as follows: the liquid ejecting apparatus 11 sucks the ambient air from the third suction opening 163 kept further separated from the optical machine 40 than the second rotation body 212 and does not suck the ambient air from the second suction opening 218 positioned on the optical machine 40 side relative to the second rotation body 212. The liquid ejecting apparatus 11 may reduce the degree of suction from the second suction opening 218 compared to that from the third suction opening 163.

When a plurality of the suction openings (first and second suction openings 118, 218) exist between the second rotation body 212 and the optical machine 40, the liquid ejecting apparatus 11 does not necessarily suck from the first suction opening 118 on the optical machine 40 side or may reduce the degree of suction from the first suction opening 118.

As illustrated in FIG. 12, the first suction opening 118 is disposed at an upstream position where the first suction opening 118 is on the first rotation body 112 side relative to the optical machine 40 in the transport direction Y when the first nozzle group 41 and the first rotation body 112 face each other. The first suction opening 118 extends farther from the optical machine 40 than the first nozzle group 41 in the transport direction Y.

In the transport direction Y, the second suction opening 218 is disposed upstream of the optical machine 40 when the second nozzle group 42 and the second rotation body 212 face each other. The second suction opening 218 extends farther from the optical machine 40 than the second nozzle group 42 in the transport direction Y. It is preferable that at least part of the optical machine 40 be positioned in the image forming area FA during the flushing.

Figure 13:
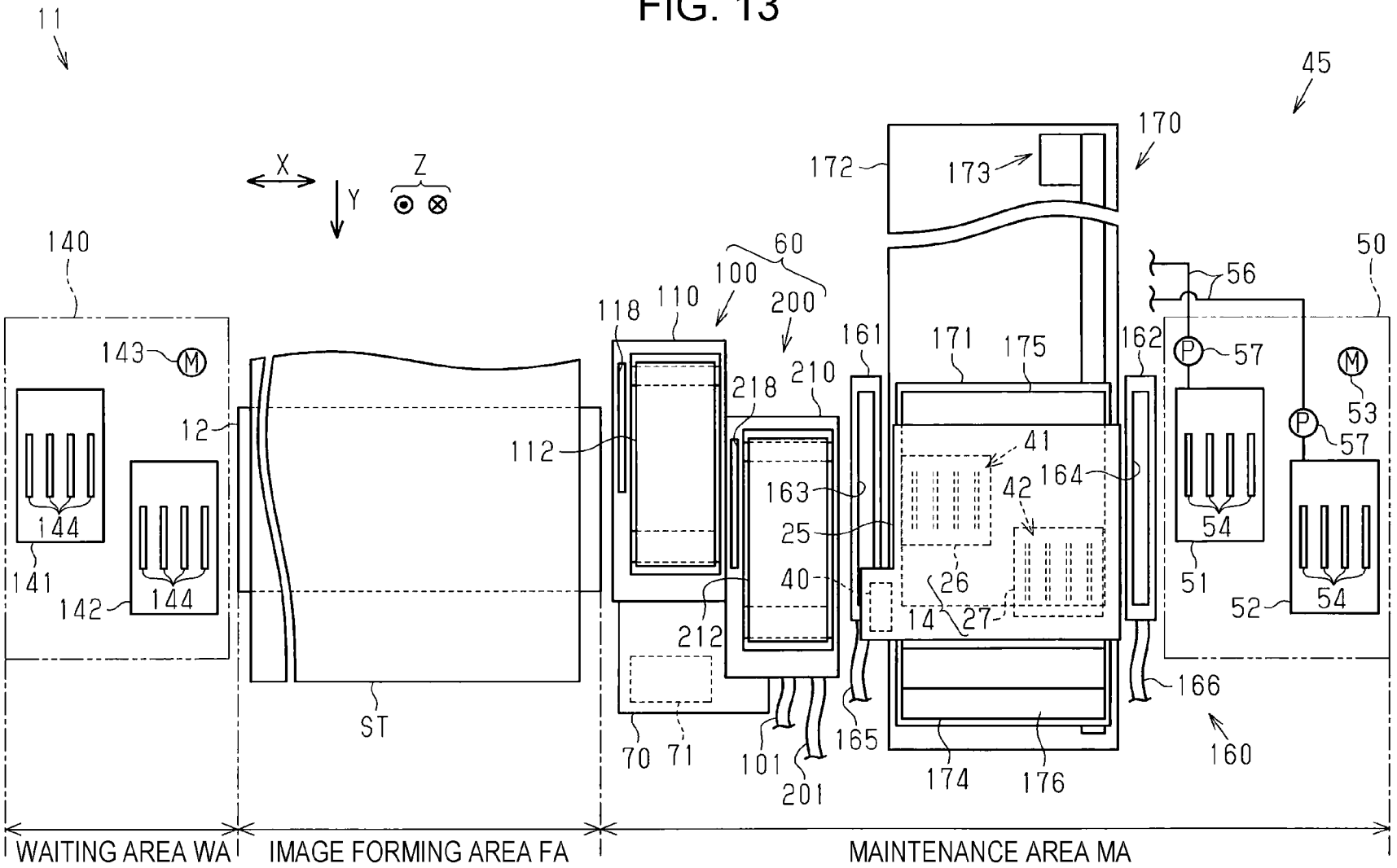
FIG. 13 is a top view schematically illustrating the part of the liquid ejecting apparatus during pressure cleaning.

As illustrated in FIG. 13, during the pressure cleaning, the liquid ejecting apparatus 11 ejects the first and second liquids from the first and second nozzle groups 41, 42 while the first and second liquid ejecting heads 26, 27 face the liquid collector 175. At this time, the fourth suction opening 164 is positioned on the liquid collector 175 side relative to the optical machine 40. That is, the fourth suction opening 164 is kept further separated from the optical machine 40 than from the liquid collector 175. The liquid ejecting apparatus 11 sucks the ambient air from the fourth suction opening 164 and does not suck the ambient air from the first, second, or third suction opening 118, 218, 163 kept further separated from the liquid collector 175 than the optical machine 40. Alternatively, the liquid ejecting apparatus 11 may perform suction from the first, second, third, and fourth suction openings 118, 218, 163, 164 with the degree of suction from the first, second, and third suction openings 118, 218, 163 reduced compared to the degree of suction from the fourth suction opening 164.

Figure 14:
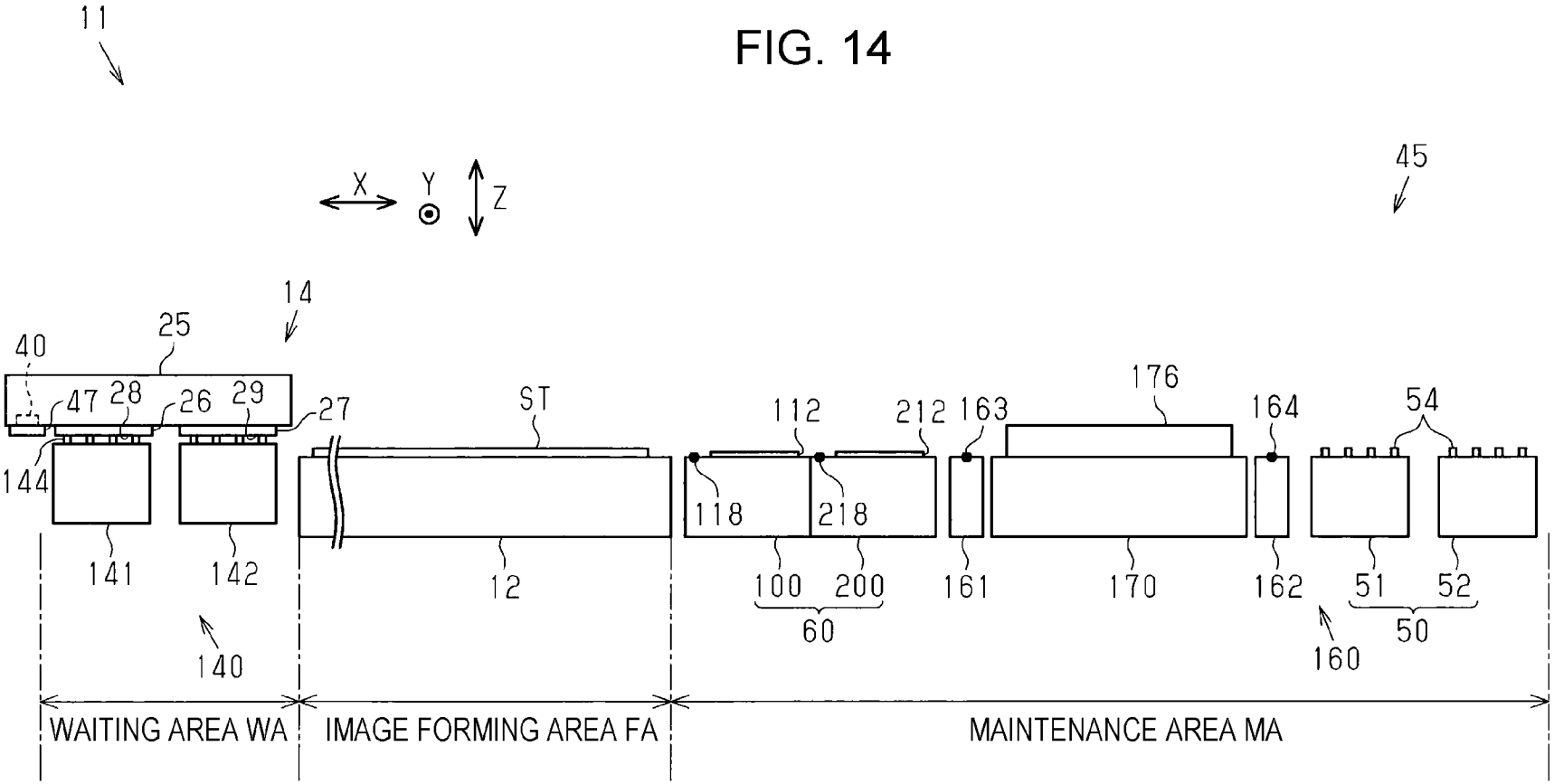
FIG. 14 is a front view schematically illustrating the part of the liquid ejecting apparatus during capping.

As illustrated in FIG. 14, in a capping state in which the nozzle forming surfaces 28, 29 are capped with the capping mechanism 140, the optical machine 40 is kept further separated from the image forming area FA than the liquid ejecting unit 14 in the width direction X.

With the above-described embodiment, the following effects can be obtained.

1. The suction mechanism 160 having the first, second, third, and fourth suction openings 118, 218, 163, 164 sucks the ambient air at a position on one of the first rotation body 112 side, the second rotation body 212 side, the liquid collector 175 side, and the cloth sheet 176 side relative to the optical machine 40. Thus, even when airborne droplets are generated due to the flushing or pressure cleaning in which the liquids are discharged, the airborne droplets can be sucked together with the ambient air. This can reduce the likelihood of the droplets adhering to the optical machine 40.

2. During the flushing, the first suction opening 118 is positioned between the optical machine 40 and the first rotation body 112. During the flushing, the second suction opening 218 is positioned between the optical machine 40 and the second rotation body 212. Thus, the airborne droplets generated on the first and second rotation bodies 112, 212 side during the flushing can be sucked by the suction mechanism 160 while the airborne droplets are moving toward the optical machine 40. This can further reduce the likelihood of the droplets adhering to the optical machine 40.

3. During the flushing, the first suction opening 118 is positioned at the first rotation body 112 side relative to the optical machine 40. Thus, the suction mechanism 160 can suppress the movement of the airborne droplets generated on the first rotation body 112 side during the flushing toward the optical machine 40. This can further reduce the likelihood of the droplets adhering to the optical machine 40.

4. The airborne droplets are likely to be generated in the image forming area FA in which the liquid ejecting unit 14 ejects the droplets and the maintenance area MA in which the first and second rotation bodies 112, 212, the liquid collector 175, and the cloth sheet 176 are provided. In this regard, the optical machine 40 is, in the capping state, kept further separated from the image forming area FA and the maintenance area MA than the liquid ejecting unit 14. This can reduce the likelihood of the droplets flying in the apparatus adhering to the optical machine 40 even when the liquid ejecting unit 14 is capped and in a waiting state.

5. Since the optical machine 40 is kept further separated from the second nozzle group 42 than the first nozzle group 41, the optical machine 40 can be kept separated from the second nozzle group 42. This can reduce degradation of optical performance due to adhering of the droplets to the optical machine 40 even when, for example, ink that contains colorant is ejected as the liquid from the second nozzle group 42.

6. The position of the first nozzle group 41 is different from the position of the second nozzle group 42 in the transport direction Y, and the optical machine 40 is disposed on the second nozzle group 42 side relative to the first nozzle group 41 in the transport direction Y. This can reduce the size of the carriage 25 compared to the case where, for example, the optical machine 40 is kept further separated from the second nozzle group 42 than the first nozzle group 41 in the transport direction Y.

7. Since the liquid ejecting apparatus 11 includes the cover member 47, the possibility of the droplets directly adhering to the optical machine 40 can be reduced. The wiping device 170 can wipe the cover member 47. Thus, even when the droplets adhere to the cover member 47, the cover member 47 is wiped by the wiping device 170. This can reduce degradation of optical performance of the optical machine 40.

The above-described embodiment may be varied as in variations described below. Furthermore, the structures included in the above-described embodiment and structures included in the following variations may be arbitrarily combined, and the structures included in the following variations may be arbitrarily combined with each other. In the following description, elements having the same functions as those of the elements that have already been mentioned are denoted by the same reference signs, thereby redundant description is omitted.

Figure 15:
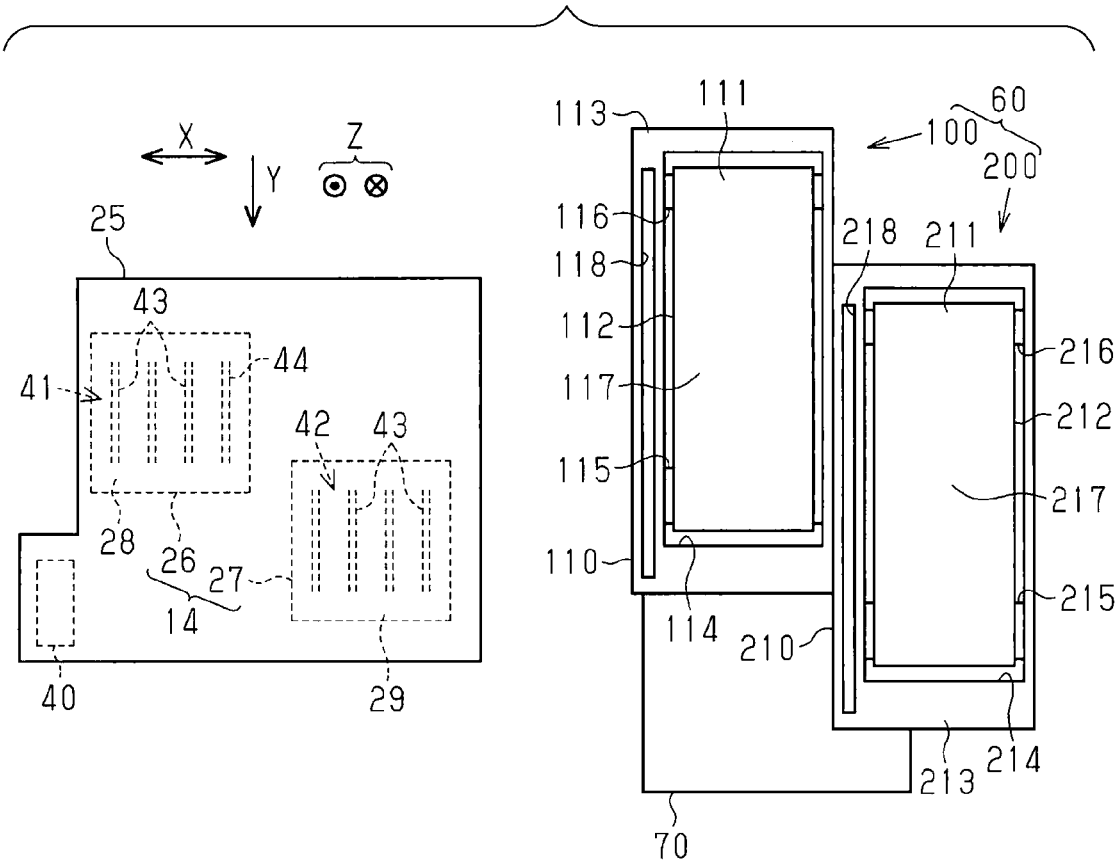
FIG. 15 is a top view schematically illustrating part of a liquid ejecting apparatus according to a first variation.

As illustrated in FIG. 15, the first and second suction openings 118, 218 may be superposed on the optical machine 40 in the transport direction Y (first variation). That is, the first suction opening 118 and the optical machine 40 may be partially superposed in each other when seen in the width direction X, and the second suction opening 218 and the optical machine 40 may be partially superposed on each other when seen in the width direction X. The second suction opening 218 may extend to a position on the opposite side to the first rotation body 112 relative to the optical machine 40 in the transport direction Y.

Figure 16:
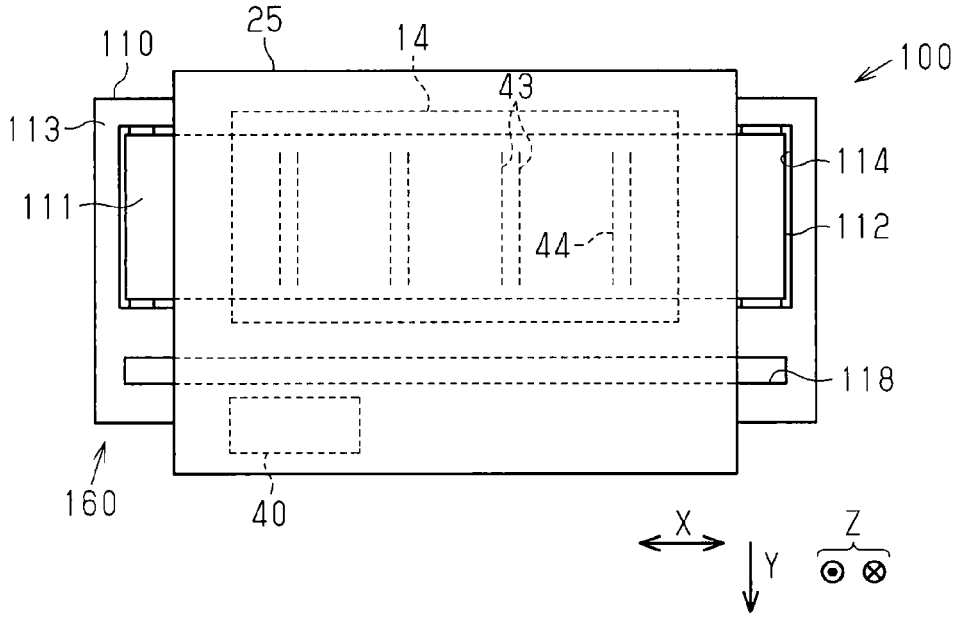
FIG. 16 is a top view schematically illustrating part of a liquid ejecting apparatus according to a second variation.

As illustrated in FIG. 16, the optical machine 40 may be disposed downstream of the liquid ejecting unit 14 in the transport direction Y. The first suction opening 118 may be adjacent to the first rotation body 112 in the transport direction Y and extend in the width direction X between the first rotation body 112 and the optical machine 40 in the transport direction Y (second variation). The first and second rotation bodies 112, 212 may be structured such that the circumferential surfaces 111, 211 are rotated so as to be moved in the width direction X.

Figure 17:
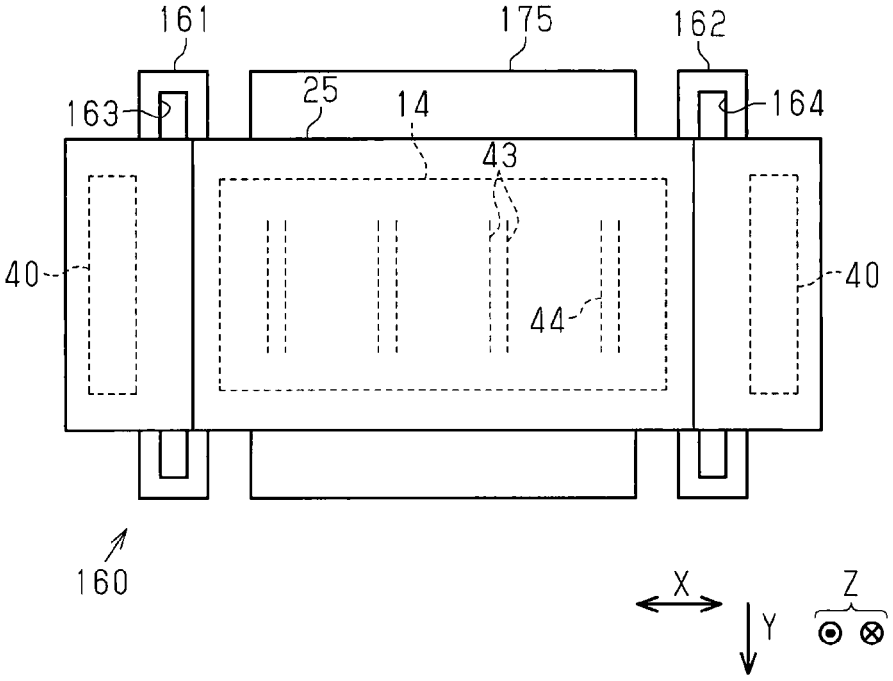
FIG. 17 is a top view schematically illustrating part of a liquid ejecting apparatus according to a third variation.

As illustrated in FIG. 17, the liquid ejecting apparatus 11 may include a plurality of optical machines 40 held by the carriage 25 (third variation). For example, when the optical machines 40 are radiating devices that radiate ultraviolet rays or the like, the optical machine 40 may be disposed on both sides of the liquid ejecting unit 14 in the width direction X. The positions of the optical machines 40 may be the same as that of the liquid ejecting unit 14 in the transport direction Y. It is preferable that the suction mechanism 160 have the third suction opening 163 and the fourth suction opening 164 each positioned between a corresponding one of the optical machines 40 and the liquid collector 175.

The liquid ejecting apparatus 11 may print on the medium ST an image representing information about, for example, the maintenance unit 45 such as the number of times of use, the number of days elapsed from the start of use, use history, and a use environment and cause the optical machine 40 to read the printed image. The liquid ejecting apparatus 11 may display the image read by the optical machine 40 in a display (not illustrated).

In the liquid ejecting apparatus 11, the suction openings may be positioned in the image forming area FA. Thus, mists generated when printing is performed on the medium ST can be absorbed. Preferably, suction from the suction openings positioned in the image forming area FA be stopped or reduced in degree during the flushing or pressure cleaning.

Suction from the suction openings 118, 218, 163, 164 is not necessarily synchronized with the flushing or pressure cleaning. It is preferable that suction from the suction openings 118, 218, 163, 164 have been performed when the flushing or pressure cleaning is completed. It is preferable that the liquid ejecting apparatus 11 start suction from the suction openings 118, 218, 163, 164 before the flushing or pressure cleaning and continue the suction for a specified period of time from time when the flushing or pressure cleaning is completed.

The second rotation body 212 may be configured such that the receiving surface 217 of the circumferential surface 211 to which the second liquid is ejected is rotated so as to be moved toward the downstream side in the transport direction Y. That is, the second rotation body 212 may be rotated in a direction separating from the first rotation body 112 in the transport direction Y. In this case, the possibility of the mist of the second liquid flowing toward the first rotation body 112 can be reduced due to a flow of gas generated by the rotation of the second rotation body 212.

The first rotation body 112 may be configured such that the receiving surface 117 of the circumferential surface 111 to which the first liquid is ejected is rotated so as to be moved toward the downstream side in the transport direction Y.

The first and second suction openings 118, 218 may be provided in other elements than the first and second receiving units 100, 200.

The diameters of the drive rollers 115, 215 are not necessarily larger than those of the driven rollers 116, 216. For example, the diameters of the drive rollers 115, 215 may be smaller than or the same as those of the driven rollers 116, 216.

Moisture-retentive liquids for maintaining the first and second liquids in a moist environment may be supplied to the first and second collectors 153, 253 through the connecting portions 156, 256 of the first and second collectors 153, 253. In this way, the insides of the containing chambers 134, 234 of the first and second rotation-body holders 110, 210 are maintained in a moist environment by the moisture-retentive liquids. This can suppress drying of the first and second liquids adhering to the first and second rotation bodies 112, 212, and accordingly, the possibility of the liquids firmly adhering to the circumferential surfaces 111, 211 due to drying can be further reduced. The moisture-retentive liquids may be supplied to the moisture-retentive caps 144.

The first and second rotation bodies 112, 212 do not necessarily include belt-shaped members such as belts and may include rotatable rollers. In this case, it is preferable that the rotation axes of the rollers extend in a direction coincident with the direction in which the nozzle rows 43 extend. One of the first and second rotation bodies 112, 212 may include a belt-shaped member and the other of the first and second rotation bodies 112, 212 may include a roller.

The liquid ejecting apparatus 11 may include a third rotation body in addition to the first rotation body 112 and the second rotation body 212. That is, the liquid ejecting apparatus 11 may include three or more liquid receiving units, which can receive the liquids ejected by the flushing, corresponding to the types of liquids ejected by the liquid ejecting unit 14.

The first liquid may be a posttreatment liquid to be ejected to the medium ST to which the second liquid has been ejected. In this case, it is preferable that the first receiving unit 100 including the first rotation body 112 be positioned downstream of the second receiving unit 200 including the second rotation body 212 in the transport direction Y.

The first rotation body 112 and the second rotation body 212 may be disposed so as to be completely superposed on each other in the transport direction Y. Although it is preferable that the first and second rotation bodies 112, 212 be disposed so as to correspond to the disposition of the first and second liquid ejecting heads 26, 27 included in the liquid ejecting unit 14, the disposition of the first and second rotation bodies 112, 212 does not necessarily correspond to the disposition of the first and second liquid ejecting heads 26, 27.

The first filter member 89 and the second filter member 90 may be removably attached to the frame 88 in the filter cassette 85.

The first and second liquid ejecting heads 26, 27 may be disposed at different positions from each other so as not to be superposed on each other in the transport direction Y. The first and second liquid ejecting heads 26, 27 may be disposed at the same position in the transport direction Y.

In the case where the flushing with the liquid ejecting unit 14 is performed on the circumferential surfaces 111, 211 of the first and second rotation bodies 112, 212 while the rotation of the first and second rotation bodies 112, 212 is stopped, it is preferable that the rotation of the first and second rotation bodies 112, 212 after the flushing be performed when the liquid ejecting unit 14 is at a position where the liquid ejecting unit 14 performs the flushing or at timing at which the liquids are not ejected to the medium ST in the image forming area FA.

The first and second liquids may be ejected, as the flushing, from the liquid ejecting unit 14 to the circumferential surfaces 111, 211 of the first and second rotation bodies 112, 212 while the first and second rotation bodies 112, 212 are being rotated.

Drive sources that respectively drive the drive rollers 115, 215 of the first and second receiving units 100, 200 may be provided.

Collection boxes 80 and suction fans 81 may be provided so as to correspond to the first and second suction openings 118, 218 of the first and second rotation-body holders 110, 210 and the third and fourth suction openings 163, 164 of the first and second suction units 161 and 162. Furthermore, suction from the first, second, third, and fourth suction openings 118, 218, 163, 164 may be performed at different timing.

When printing is performed by ejecting to the medium ST the liquids by the liquid ejecting unit 14 in the image forming area FA, suction may be performed with at least one of the first, second, third, and fourth suction openings 118, 218, 163, 164, for example, with the first suction opening 118. Furthermore, in so doing, the degree of suction may be reduced compared to that during the flushing.

The heater unit 15 may be disposed downstream of a moving area of the carriage 25 in the transport direction Y so as to enhance drying of the liquids adhering to the medium ST.

The heater unit 15 may be omitted.

The cover member 47 may be omitted from the liquid ejecting apparatus 11.

The wiping device 170 may be omitted from the liquid ejecting apparatus 11. At least one of the liquid collector 175 and the cloth sheet 176 may be omitted from the liquid ejecting apparatus 11.

At least one of the first and second rotation bodies 112, 212 may be omitted from the liquid ejecting apparatus 11.

The cover member 47 may be positioned so as not to interfere with the cloth sheet 176. That is, the wiping device 170 does not necessarily wipe the cover member 47.

The optical machine 40 may be kept further separated from the first nozzle group 41 than the second nozzle group 42 in the width direction X. The optical machine 40 may be provided at the same position as that of the first nozzle group 41 or the second nozzle group 42 in the width direction X.

The optical machine 40 may be kept further separated from the first nozzle group 41 than the second nozzle group 42 in the transport direction Y. The optical machine 40 may be kept further separated from the second nozzle group 42 than the first nozzle group 41 in the transport direction Y. The optical machine 40 may be provided at the same position as that of the first nozzle group 41 or the second nozzle group 42 in the transport direction Y.

The liquid ejecting unit 14 may include one of the first and second liquid ejecting heads 26, 27. The liquid ejecting unit 14 may include one of the first and second nozzle groups 41, 42.

The ink may be ejected from both the first and second nozzle groups 41, 42.

The waiting area WA and the maintenance area MA may be provided on the same side. For example, the waiting area WA may be kept further separated from the image forming area FA than the maintenance area MA.

In the capping state in which the nozzle forming surfaces 28, 29 are capped with the capping mechanism 140, the optical machine 40 may be positioned closer to the image forming area FA than the liquid ejecting unit 14.

The suction mechanism 160 may have at least one of the first, second, third, and fourth suction openings 118, 218, 163, 164. At least one of the first, second, and third suction openings 118, 218, 163 may be omitted from the suction mechanism 160. For example, the suction mechanism 160 does not necessarily have the first suction opening 118 that is positioned, when the first nozzle group 41 and the first rotation body 112 face each other, between the first rotation body 112 and the optical machine 40 in the width direction X. The suction mechanism 160 does not necessarily have the first and second suction openings 118, 218 that are positioned, when the second nozzle group 42 and the second rotation body 212 face each other, between the second rotation body 212 and the optical machine 40 in the width direction X. The suction mechanism 160 does not necessarily have the first, second, and third suction openings, 118, 218, 163 that are positioned, when the first and second nozzle groups 41, 42 face the liquid collector 175, on the opposite side to the liquid collector 175 relative to the optical machine 40 in the width direction X.

In the above-described embodiment, the liquid ejecting apparatus may eject or discharge another liquid than ink as the second liquid. States of the liquids discharged from the liquid ejecting apparatus as a small number of droplets include a granular shape, a tear shape, and a shape with a filiform trail. Herein, it is sufficient that each of the liquids be a material that can be ejected from the liquid ejecting apparatus. For example, it is sufficient that the liquid be a material that is a substance in the liquid phase. Thus, the liquid may be a material of a high viscosity or a low viscosity in a liquid state, a sol, gel-water, or another type of an inorganic solvent, an organic solvent, or a solution, or a material in a flowing state such as liquid resin or liquid metal (molten metal). Furthermore, the liquid refers not only to a liquid as a state of a substance but also to a particle of a functional material containing a solid substance such as a pigment or a metal particle dissolved in, dispersed in, or mixed with a solvent. Typical examples of the liquid include, for example, ink as described above in the embodiment and liquid crystal. Here, the ink refers to a usual water-based or oil-based ink, or any of various liquid compositions such as gel ink and hot-melt ink. A specific example of the liquid ejecting apparatus ejects a liquid containing a material such as an electrode material or colorant dispersed or dissolved therein used for the manufacture or the like of, for example, liquid crystal displays, electroluminescent (EL) displays, field emission displays, or color filters. The liquid ejecting apparatus may eject, for example, biological organic matter used for the manufacture of biochips, may be used as a precision pipet and eject a liquid used as a sample, or may be a textile printing device or a micro dispenser. The liquid ejecting apparatus may perform pinpoint ejection of lubricant to precision mechanical instruments such as clocks and cameras or eject to substrates a transparent resin liquid such as an ultraviolet curable resin liquid for forming micro-semispherical lenses (optical lenses) or the like used for, for example, optical communication elements. The liquid ejecting apparatus may eject acidic or alkaline etchants for etching, for example, substrates.

Technical thoughts and operational effects understood from the above-described embodiment and variations are described below.

Thought 1

A liquid ejecting apparatus includes a liquid ejecting unit, a carriage, an optical machine, a liquid receiving unit, and a suction mechanism. The liquid ejecting unit is able to form an image by ejecting a droplet from a nozzle formed in a nozzle forming surface to a medium. The carriage holds the liquid ejecting unit. The optical machine is held by the carriage.

The liquid receiving unit is able to receive a liquid discharged from the liquid ejecting unit due to a discharge operation for maintenance of the liquid ejecting unit. The suction mechanism has a suction opening that is disposed at a position which is adjacent to the liquid receiving unit and which is, during the discharge operation, disposed on a liquid receiving unit side relative to the optical machine so as to allow ambient air on a liquid ejecting unit side to be sucked therefrom.

With this structure, the suction mechanism having the suction opening sucks the ambient air on the liquid receiving unit side relative to the optical machine. Thus, even when an airborne droplet is generated due to the discharge operation in which the liquid is discharged, the airborne droplet can be sucked together with the ambient air. This can reduce the likelihood of the droplet adhering to the optical machine.

Thought 2

In the liquid ejecting apparatus, it is preferable that, in a direction in which the liquid receiving unit and the suction opening are adjacent to each other, the suction opening be positioned between the optical machine and the liquid receiving unit during the discharge operation.

With this structure, the suction opening is positioned between the optical machine and the liquid receiving unit during the discharge operation. Thus, the airborne droplet generated on the liquid receiving unit side during the discharge operation can be sucked by the suction mechanism while the airborne droplet is moving toward the optical machine. This can further reduce the likelihood of the droplet adhering to the optical machine.

Thought 3

In the liquid ejecting apparatus, it is preferable that, in a direction intersecting a direction in which the liquid receiving unit and the suction opening are adjacent to each other, the suction opening be positioned on the liquid receiving unit side relative to the optical machine during the discharge operation.

With this structure, the suction opening is positioned on the liquid receiving unit side relative to the optical machine during the discharge operation. Thus, the suction mechanism can suppress the movement of the airborne droplet generated on the liquid receiving unit side during the discharge operation toward the optical machine. This can further reduce the likelihood of the droplet adhering to the optical machine.

Thought 4

In the liquid ejecting apparatus, it is preferable that, when an area where the image is formed by ejecting the droplet using the liquid ejecting unit to the medium is an image forming area and a direction in which the medium is transported is a transport direction, the liquid receiving unit and the suction opening be provided in a maintenance area adjacent to the image forming area in a scan direction in which the carriage performs scanning and which intersects the transport direction, the liquid ejecting apparatus further include a capping mechanism that is disposed in a waiting area which is adjacent to the image forming area on an opposite side to the maintenance area in the scan direction and that caps the nozzle forming surface including the nozzle, and, in a capping state in which the nozzle forming surface is capped, the optical machine be kept further separated from the image forming area than the liquid ejecting unit in the scan direction.

The airborne droplet is likely to be generated in the image forming area in which the liquid ejecting unit ejects the droplet and the maintenance area in which the liquid receiving unit is provided. In this regard, with this structure, the optical machine is, in the capping state, kept further separated from the image forming area and the maintenance area than the liquid ejecting unit. This can reduce the likelihood of the droplet flying in the apparatus adhering to the optical machine even when the liquid ejecting unit is capped and in a waiting state.

Thought 5

In the liquid ejecting apparatus, it is preferable that the liquid ejecting unit have a first nozzle group that ejects a treatment liquid which enhances fixing of the liquid to the medium and a second nozzle group that ejects the liquid. In this case, the optical machine is kept further separated from the second nozzle group than the first nozzle group.

With this structure, since the optical machine is kept further separated from the second nozzle group than the first nozzle group, the optical machine can be kept separated from the second nozzle group. This can reduce degradation of optical performance due to adhering of the droplet to the optical machine even when, for example, ink that contains colorant is ejected as the liquid from the second nozzle group.

Thought 6

In the liquid ejecting apparatus, it is preferable that, when a direction in which the medium is transported is a transport direction, the carriage perform scanning in a scan direction intersecting the transport direction, the first nozzle group and the second nozzle group be adjacent to each other in the scan direction and at different positions in the transport direction, and the optical machine be kept further separated from the second nozzle group than the first nozzle group in the scan direction and on a second nozzle group side relative to the first nozzle group in the transport direction.

With this structure, the position of the first nozzle group is different from the position of the second nozzle group in the transport direction, and the optical machine is disposed on the second nozzle group side relative to the first nozzle group in the transport direction Y. This can reduce the size of the carriage compared to the case where, for example, the optical machine is kept further separated from the second nozzle group than the first nozzle group in the transport direction.

Thought 7

It is preferable that the liquid ejecting apparatus further include a wiping device that is able to wipe the nozzle forming surface and a cover member provided on a side of the optical machine facing the medium. In this case, the cover member is provided at a position where the wiping device is able to wipe the cover member.

With this structure, since the liquid ejecting apparatus includes the cover member, the possibility of the droplet directly adhering to the optical machine can be reduced. The wiping device can wipe the cover member. Thus, even when the droplet adheres to the cover member, the cover member is wiped by the wiping device. This can reduce degradation of optical performance of the optical machine.

Thought 8

In a method of maintaining a liquid ejecting apparatus, the liquid ejecting apparatus includes a liquid ejecting unit, a carriage, an optical machine, a liquid receiving unit, and a suction mechanism. The liquid ejecting unit is able to form an image by ejecting a droplet from a nozzle formed in a nozzle forming surface to a medium. The carriage holds the liquid ejecting unit. The optical machine is held by the carriage. The liquid receiving unit is able to receive a liquid discharged from the liquid ejecting unit due to a discharge operation for maintenance of the liquid ejecting unit. The suction mechanism has a suction opening that allows ambient air on a liquid ejecting unit side to be sucked therefrom. The method includes operating the suction mechanism during the discharge operation so as to suck the ambient air from the suction opening that is disposed at a position which is adjacent to the liquid receiving unit and which is, during the discharge operation, disposed on a liquid receiving unit side relative to the optical machine.

With this structure, the effects similar to those of the liquid ejecting apparatus can be produced.

The entire disclosure of Japanese Patent Application No. 2017-194871, filed Oct. 5, 2017 is expressly incorporated by reference herein.

What is claimed is:

1. A liquid ejecting apparatus comprising:

a liquid ejecting unit designed to form an image by ejecting a droplet from a nozzle formed in a nozzle forming surface to a medium;

a carriage holding the liquid ejecting unit;

an optical machine held by the carriage;

a liquid receiving unit designed to receive a liquid discharged from the liquid ejecting unit in a discharge operation for maintenance of the liquid ejecting unit; and a suction mechanism having a surface provided with a suction opening that is disposed at a position which is adjacent to the liquid receiving unit, the suction opening being disposed on a liquid receiving unit side relative to the optical machine so as to allow ambient air on a liquid ejecting unit side to be sucked therefrom during the discharge operation.

2. The liquid ejecting apparatus according to claim 1, wherein, in a direction in which the liquid receiving unit and the suction opening are adjacent to each other, the suction opening is positioned between the optical machine and the liquid receiving unit during the discharge operation.

3. The liquid ejecting apparatus according to claim 1, wherein, in a direction intersecting a direction in which the liquid receiving unit and the suction opening are adjacent to each other, the suction opening is positioned on the liquid receiving unit side relative to the optical machine during the discharge operation.

4. The liquid ejecting apparatus according to claim 1, wherein, when an area where the image is formed by ejecting the droplet using the liquid ejecting unit to the medium is an image forming area and a direction in which the medium is transported is a transport direction, the liquid receiving unit and the suction opening are provided in a maintenance area adjacent to the image forming area in a scan direction in which the carriage performs scanning and which intersects the transport direction, wherein the liquid ejecting apparatus further includes a capping mechanism that is disposed in a waiting area which is adjacent to the image forming area on an opposite side to the maintenance area in the scan direction and that caps the nozzle forming surface including the nozzle, and wherein, in a capping state in which the nozzle forming surface is capped, the optical machine is kept further separated from the image forming area than the liquid ejecting unit in the scan direction.

5. The liquid ejecting apparatus according to claim 1, wherein the liquid ejecting unit has a first nozzle group that ejects a treatment liquid which enhances fixing of the liquid to the medium, and a second nozzle group that ejects the liquid, wherein the optical machine is kept further separated from the second nozzle group than the first nozzle group.

6. The liquid ejecting apparatus according to claim 5, wherein, when a direction in which the medium is transported is a transport direction, the carriage performs scanning in a scan direction intersecting the transport direction, wherein the first nozzle group and the second nozzle group are adjacent to each other in the scan direction and at different positions in the transport direction, and wherein the optical machine is kept further separated from the second nozzle group than the first nozzle group in the scan direction and on a second nozzle group side relative to the first nozzle group in the transport direction.

7. The liquid ejecting apparatus according to claim 1, further comprising:

a wiping device designed to wipe the nozzle forming surface; and a cover member provided on a side of the optical machine facing the medium, wherein the cover member is provided at a position where the wiping device is configured to wipe the cover member.

* * * * *